US012618619B2

(12) United States Patent
Rendall et al.

(10) Patent No.: US 12,618,619 B2
(45) Date of Patent: May 5, 2026

(54) OPTIMIZED HEAT EXCHANGER AND METHODS FOR DESIGNING THE SAME

(71) Applicant: UT-Battelle, LLC, Oak Ridge, TN (US)

(72) Inventors: Joseph D. Rendall, Knoxville, TN (US); Som S. Shrestha, Knoxville, TN (US); Zhenglai Shen, Knoxville, TN (US); Diana Hun, Lenoir City, TN (US); Achutha Tamraparni, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 98 days.

(21) Appl. No.: 18/614,115

(22) Filed: Mar. 22, 2024

(65) Prior Publication Data

US 2025/0109911 A1 Apr. 3, 2025

Related U.S. Application Data

(60) Provisional application No. 63/541,009, filed on Sep. 28, 2023.

(51) Int. Cl.
*F28D 20/02* (2006.01)
*F28D 20/00* (2006.01)

(52) U.S. Cl.
CPC ..... *F28D 20/0034* (2013.01); *F28D 20/021* (2013.01)

(58) Field of Classification Search
CPC ..... F28D 20/021; Y02E 60/14
See application file for complete search history.

(56) References Cited

U.S. PATENT DOCUMENTS 11,378,282 B2 7/2022 Field et al.
2020/0049424 A1* 2/2020 Suzuki ..... F28D 20/028
(Continued)

FOREIGN PATENT DOCUMENTS

DE 602005001584 T2 * 4/2008 ..... F28D 7/085
EP 3252418 A1 12/2017
(Continued)

OTHER PUBLICATIONS

K. Biswas, S. Shrestha, D. Hun, J. Atchley, Thermally Anisotropic Composites for Improving the Energy Efficiency of Building Envelopes, Energies. 12 (2019) 195-209.
(Continued)

*Primary Examiner* — Eric S Ruppert
(74) *Attorney, Agent, or Firm* — Fox Rothschild LLP

(57) ABSTRACT

A heat storage system, and systems and methods for designing a heat exchanger system included in the heat storage system are disclosed. The heat exchanger system includes a heat exchanger including a plurality of planar fins parallelly arranged between a first header and a second header, and a plurality of tubes configured to be received in axially aligned holes of the plurality of fins, the plurality of tubes being configured to allow flow of a fluid exchanger fluid. The heat storage system also includes a storage tank comprising phase change material (PCM) for at least partially submerging the heat exchanger within the PCM. A spacing between the plurality of fins is optimized using a finite particle model of the heat exchanger to achieve a performance objective of at least 75% thermal heat discharge from the PCM in about 3 hours.

9 Claims, 24 Drawing Sheets

(56) References Cited

U.S. PATENT DOCUMENTS

| | | | |
|---|---|---|---|
| 2020/0217518 | A1 | 7/2020 | Field et al. |
| 2020/0326085 | A1 | 10/2020 | Shrestha et al. |

FOREIGN PATENT DOCUMENTS

| | | | | | |
|---|---|---|---|---|---|
| JP | 2005337664 | A | * | 12/2005 | ..... F28D 1/0477 |
| WO | WO-2017150993 | A1 | * | 9/2017 | ..... F28F 13/12 |

OTHER PUBLICATIONS

D. MacPhee, I. Dincer, Performance assessment of some ice TES systems, Int. J. Therm. Sci. 48 (2009) 2288-2299.

S. Tokas, G. Krishnayatra, M. Zunaid, Numerical investigation of thermal performance of extended surfaces for a novel heat exchanger, Heat Transf. 50 (2021) 329-351.

S. Deng, C. Nie, H. Jiang, W.B. Ye, Evaluation and optimization of thermal performance for a finned double tube latent heat thermal energy storage, Int. J. Heat Mass Transf. 130 (2019) 532-544.

P.S. Gadhave, C.L. Prabhune, H.P. Jagtap, P.P. Ritapure, Investigative Study of Solidification and Melting of Stearic Acid in Triplex Pipe with Perforated Fin Surface, J. Adv. Res. Fluid Mech. Therm. Sci. 98 (2022) 125-136.

A.M. Abdulateef, S. Mat, K. Sopian, J. Abdulateef, A.A. Gitan, Experimental and computational study of melting phase-change material in a triplex tube heat exchanger with longitudinal/triangular fins, Sol. Energy. 155 (2017) 142-153.

Vikas, A. Yadav, S. Samir, M. Arici, A comprehensive study on melting enhancement by changing tube arrangement in a multi-tube latent heat thermal energy storage system, J. Energy Storage. 55 (2022).

J. Gasia, J. Diriken, M. Bourke, J. Van Bael, L.F. Cabeza, Comparative study of the thermal performance of four different shell-and-tube heat exchangers used as latent heat thermal energy storage systems, Renew. Energy. 114 (2017) 934-944.

J. Woods, A. Mahvi, A. Goyal, E. Kozubal, A. Odukomaiya, R. Jackson, Rate capability and Ragone plots for phase change thermal energy storage, Nat. Energy. 6 (2021) 295-302.

Sunamp Thermino Brochure for "Easyfit Space-Saving Thermal Storage for Hot Water".

* cited by examiner

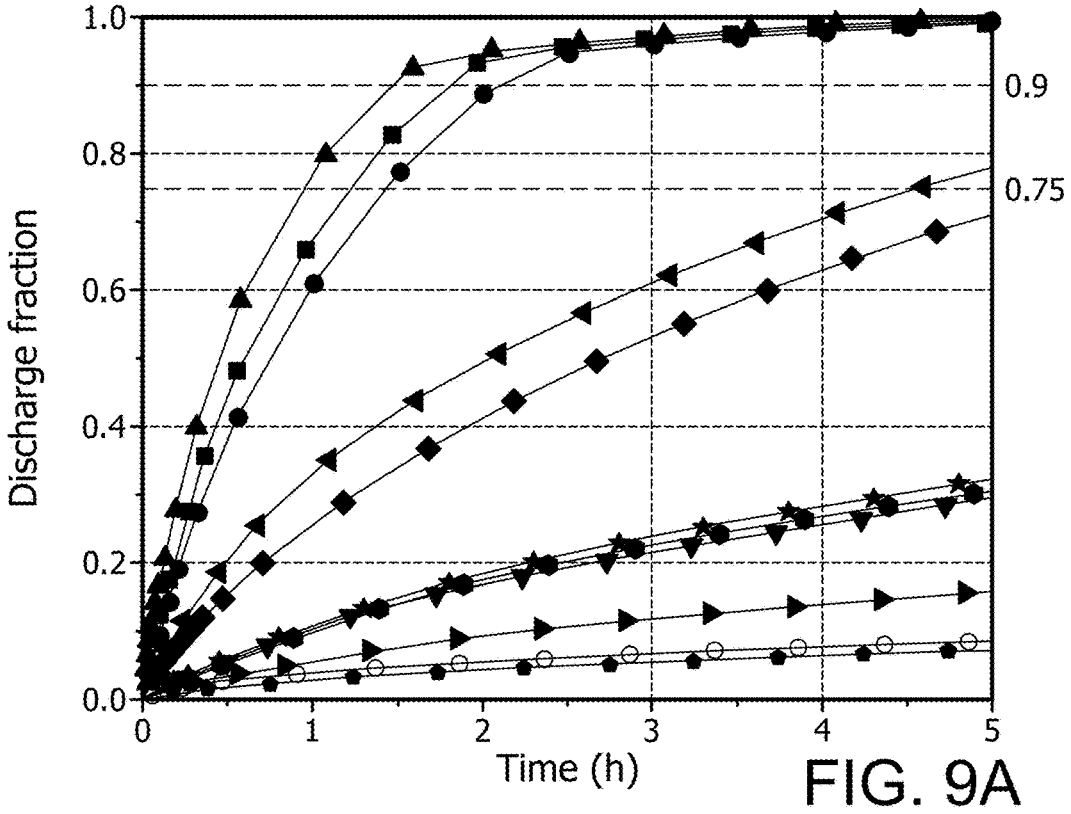
FIG. 9A
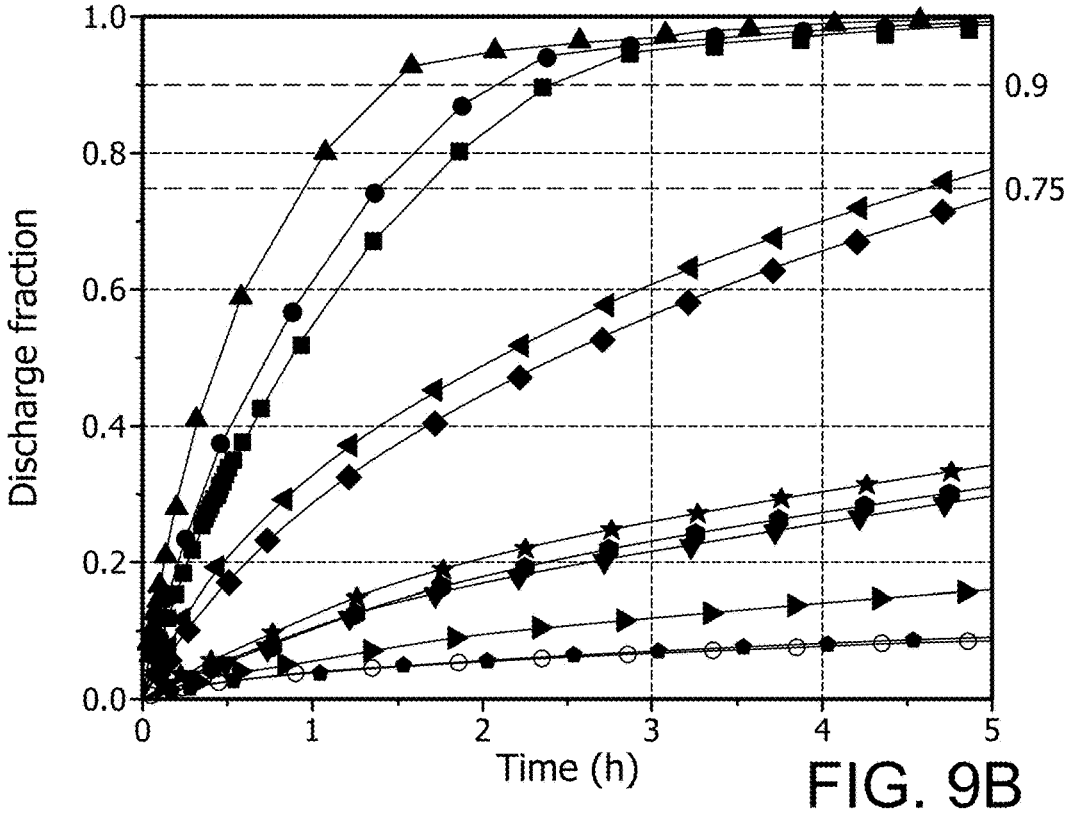
FIG. 9B
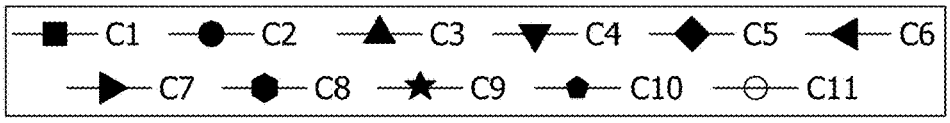

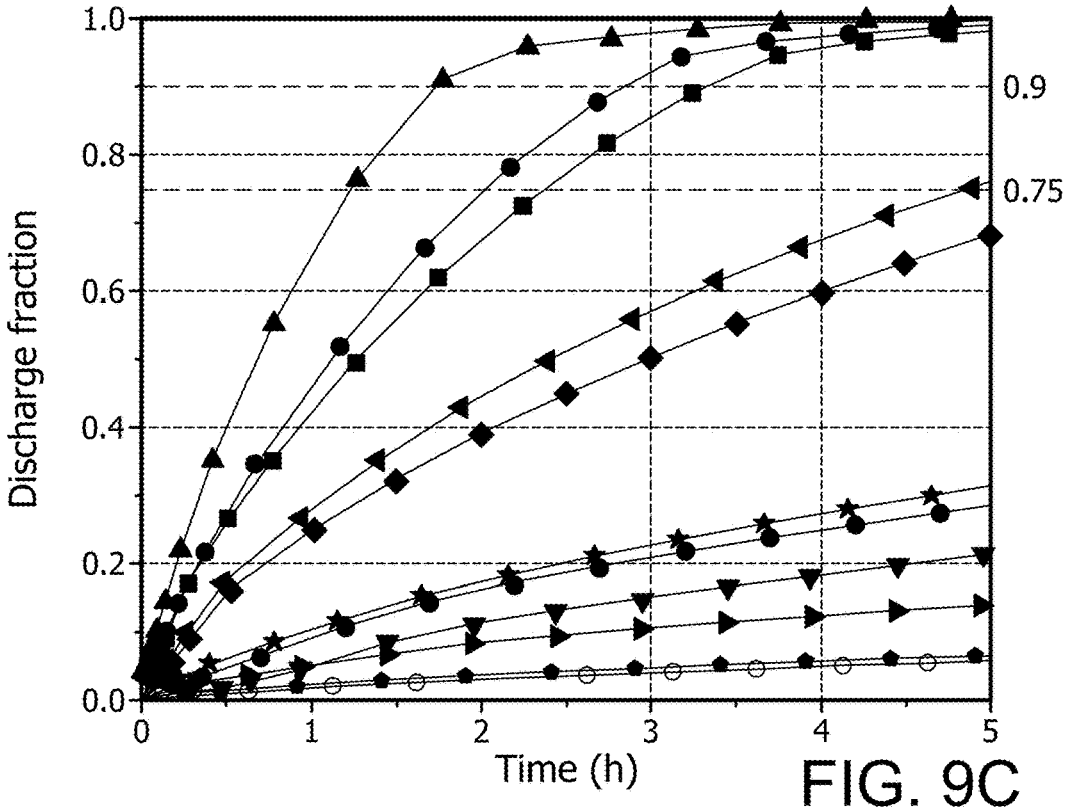
FIG. 9C
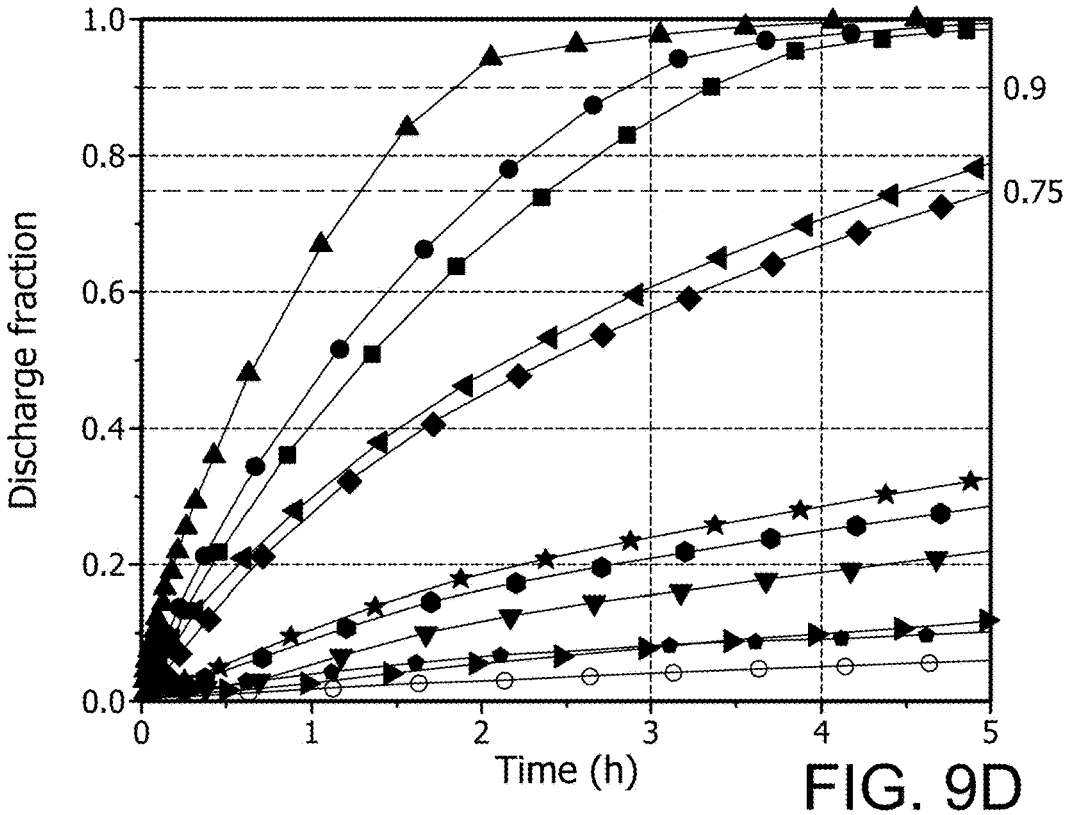
FIG. 9D
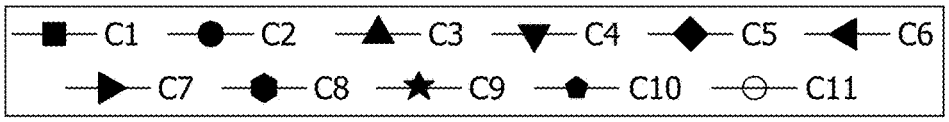

OPTIMIZED HEAT EXCHANGER AND METHODS FOR DESIGNING THE SAME

CROSS-REFERENCE TO RELATED APPLICATIONS

This application claims priority to U.S. Provisional Application 63/541,009 filed Sep. 28, 2023, entitled "AN OPTIMIZED HEAT EXCHANGER AND METHODS FOR DESIGNING THE SAME", the entire disclosure of which incorporated herein by reference.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF INVENTION

This application relates to tube and fin heat exchangers, and in particular, to novel fin design for tube and fin heat exchangers and methods of designing the same.

BACKGROUND

In 2021, US residential buildings consumed 20.8 quadrillion Btu, and commercial buildings consumed 17.0 quadrillion Btu, accounting for 21.8% and 17.9%, respectively, of the total US primary energy use that year. To reduce building energy consumption, building thermal energy loads can be stored to reduce the burden on the electrical grid. These thermal energy storage (TES) systems need to reduce the building energy consumption during peak periods, which are often up to 4 hours long. Building thermal storage has several benefits, including offsetting peak heating and cooling loads, increasing energy efficiency by reducing the mismatch between supply and demand for heating and cooling, and increasing resilience during heat waves.

In buildings, cost and footprint are major concerns for the building owners, and the TES systems need to be optimized accordingly. TES systems based on solid/liquid phase change materials (PCMs) have large volumetric latent heat energy storage values, suitable phase change temperatures, and low volumetric changes between phase transitions. However, the energy charge and discharge rates of PCM-based TES systems are severely limited because of their relatively low thermal conductivity. Additionally, even though PCMs have a high energy density, heat transfer in PCMs is complex because the melting and freezing fronts change as functions of stored or released heat, location, and time. PCMs may be used in conjunction with heat exchange systems in order to optimize PCM-based TES systems. However, prior attempts to optimize heat exchangers in one or two dimensions by maximizing the melt and freeze front area often yield fractal geometry which is often difficult to model/optimize, and hence the heat exchangers are expensive to construct.

This document describes methods and systems that are directed to addressing the problems described above, and/or other issues.

SUMMARY

In various scenarios, a heat storage system is disclosed. The heat exchanger system may include a heat exchanger including a plurality of planar fins parallelly arranged between a first header and a second header, and a plurality of tubes configured to be received in axially aligned holes of the plurality of fins, the plurality of tubes being configured to allow flow of a fluid exchanger fluid. The heat storage system may also include a storage tank comprising phase change material (PCM) for at least partially submerging the heat exchanger within the PCM. A spacing between the plurality of fins is optimized using a finite particle model of the heat exchanger to achieve a performance objective of at least 75% thermal heat discharge from the PCM in about 3 hours.

Optionally, the spacing is about 0.75 inch to about 0.14 inch.

In some implementations, a thickness of each of the plurality of fins is about 0.006 inch to about 0.06 inch.

A spacing between the plurality of tubes may also be optimized using the finite particle model of the heat exchanger and, optionally, may be about 2 inches to about 4 inches. Optionally, a diameter of each of the plurality of tubes may be about 0.375 inch to 0.16 inch.

In various implementations, the spacing can be optimized to satisfy one or more of the following ratios:

i.

$$\frac{\text{Fin spacing}}{\text{tube space}} = 0.1 \text{ to } 0.2$$

ii.

$$\frac{\text{Fin spacing}}{\text{fin thickness}} = 2.3 \text{ to } 125$$

iii.

$$\frac{\text{Fins spacing}}{\text{tube diameter}} = 0.9 \text{ to } 2$$

iv.

$$\frac{\text{Fin spacing}}{PCM \text{ conductivty}} = 0.5 \text{ to } 7.5$$

v.

$$\frac{\text{Fin spacing (inch)}}{PCM \text{ specific latent heat } \left(\frac{\text{kJ}}{\text{kg}}\right)} = 0.0042 \text{ to } 0.0006$$

vi.

$$\frac{\text{Fin spacing (inch)}}{PCM \text{ volumetric latent heat } \left(\frac{\text{kJ}}{\text{m}^3}\right)} = 0.0000047 \text{ to } 0.0000006$$

The heat exchanger can be a vertical finned horizontal tube exchanger or a horizontal finned vertical tube exchanger.

Optionally, one or more of the plurality of fins are perforated.

Optionally, one or more of the plurality of tubes may include a twisted tape insert.

In various scenarios, systems and methods for optimizing a heat exchanger design for use as heat storage by charging or discharging heat from a PCM are also disclosed. The systems may include a processor and a non-transitory computer readable medium including instructions that can be executed by the processor to perform the methods. The methods may include generating a finite element model of the heat exchanger, determining optimal values of one or more geometrical parameters of the heat exchanger, the optimal values being configured to satisfy heat exchanger design objectives, and outputting the optimal values of the one or more geometrical parameters of the heat exchanger and the finite element model in response to determining that performance results of the finite optimal model with the optimal values of the one or more geometrical parameters match the heat exchanger design objectives.

In various implementations, the methods may also include determining second optimal values of the one or more geometrical parameters of the heat exchanger in response to determining that performance results of the finite optimal model with the optimal values of one or more geometrical parameters do not match the heat exchanger design objectives.

In various implementations, the one or more geometrical parameters may include at least one of the following: fin spacing between a plurality of fins of the heat exchanger, fin thickness, tube spacing between a plurality of tubes of the heat exchanger, and/or tube diameter.

In various implementations, determining optimal values of one or more geometrical parameters of the heat exchanger may include determining the optimal values based on at least one of the following: one or more material properties of the heat exchanger elements, one or more properties of the PCM, or the finite element model. Optionally, determining optimal values of one or more geometrical parameters of the heat exchanger may also include maximizing tube spacing between a plurality of tubes of the heat exchanger.

In various implementations, the methods may also include validating the finite element model of the heat exchanger by comparing simulated results to experimental results.

Optionally, the design objectives may include achieving a heat discharge rate of the PCM of about 75% in about 3 hours.

In various implementations, the methods may also include using the output to generate a second finite model of the heat exchanger, the second finite model being larger in size compared to the finite element model.

BRIEF DESCRIPTION OF THE DRAWINGS

FIGS. 9A-9D illustrate discharge fractions of the unit-scale HX parameter study for PT18 (FIG. 9A), PT23 (FIG. 9B), HS22P (FIG. 9C), and HS24P (FIG. 9D). The targeted discharging requirements are indicated by red and blue dashed lines.

FIG. 12A showing all the studied cases, FIG. 12B showing the effect of temperature differences, FIG. 12C showing the effect of PCM thermal conductivity, and FIG. 12D showing the effect of HX materials. The targeted discharging requirements are indicated by red and blue dashed lines.

FIG. 13A showing all the studied cases; FIG. 13B showing the effect of HX materials; FIG. 13C showing the effect of temperature difference between HX and PCM; and FIG. 13D showing the effect of PCTR. The targeted discharging requirements are indicated by red and blue dashed lines.

FIG. 14A showing all the studied cases, FIG. 14B showing the effect of HX materials, FIG. 14C showing the effect of temperature difference between HX and PCM, and FIG. 14D showing effect of temperature difference variations. The targeted discharging requirements are indicated by red and blue dashed lines.

DETAILED DESCRIPTION

Figure 1A:
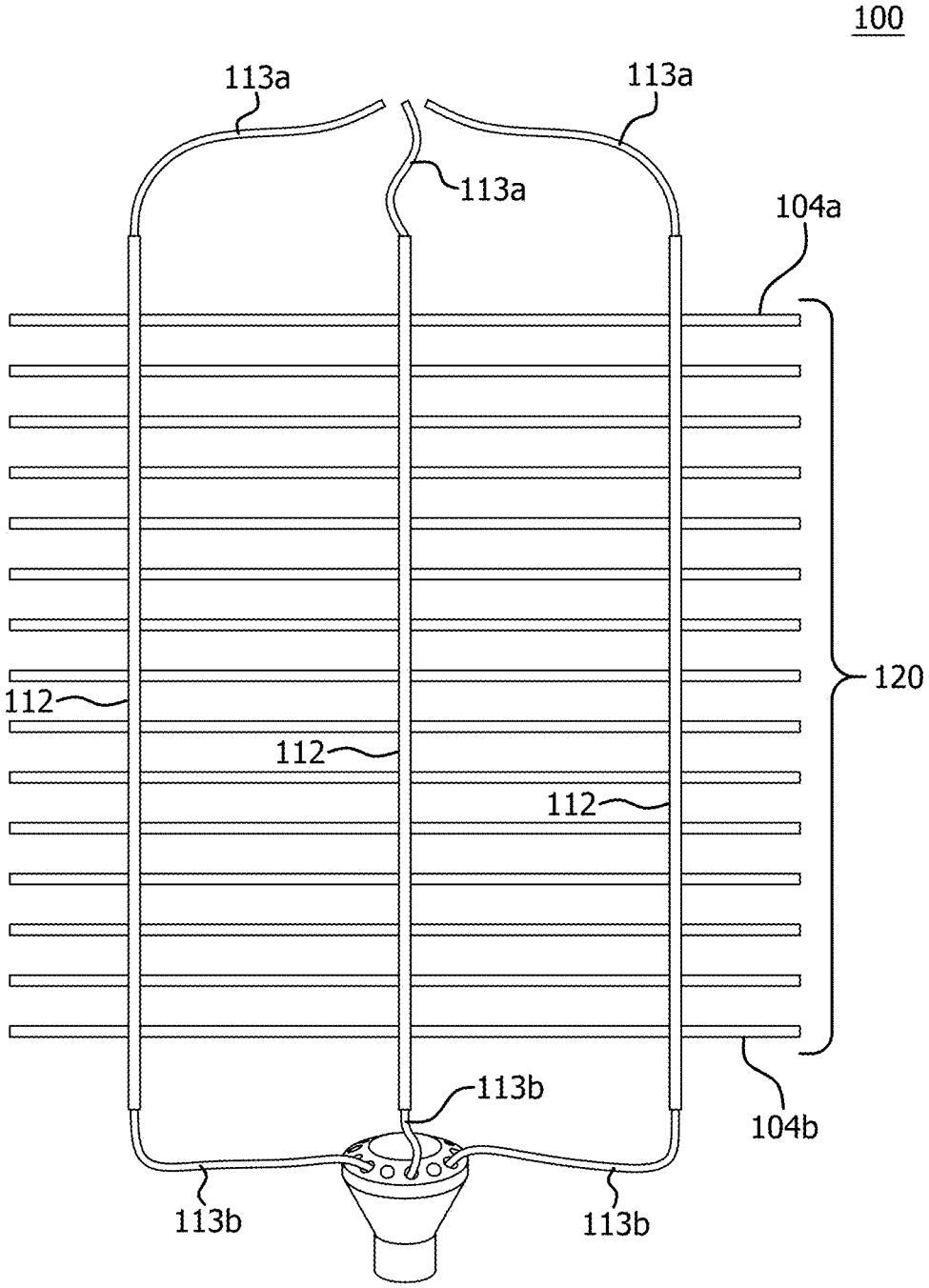
FIG. 1A illustrates an example schematic sectional view of a finned tube heat exchanger.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to." Definitions for additional terms that are relevant to this document are included at the end of this Detailed Description.

To reduce building energy consumption, a thermally anisotropic building envelope (TABE) may be utilized which can provide better thermal performance than a traditional building envelope. Thin, thermally conductive sheets made of metals such as mild steels are embedded in TABEs, and the conductive layers are connected to hydronic loops, allowing heat to dissipate in a preferential direction. Hydronic loops connected to the highly thermally conductive thin metal sheets enable the use of natural thermal energy (heating in winter and cooling in summer) from diurnal weather conditions, solar irradiance in the winter, and night sky cooling in the summer on the exterior side of the TABE roof or wall. However, the time when useful thermal energy is available and the time when the building needs such thermal energy typically do not coincide. One solution is to couple TES systems with TABE to store the collected thermal energy and release the stored energy when needed, in order to save energy and reduce peak demand. Building thermal storage has several benefits, including offsetting heating and cooling loads, increasing energy efficiency by reducing the mismatch between supply and demand for heating and cooling, and increasing resilience during heat waves.

However, TES suitable to integrate with TABE is not available. Most commercially available thermal energy storage (TES) systems are large ice tanks that are integrated with central chillers. Since the melting temperature of ice (0° C.), it is not suitable for harvesting thermal energy from TABEs because TABEs require a phase change temperature close to room temperature. As such, new TES designs are required to optimize the functionality of TES systems (e.g., for integration with TABEs) and provide potential energy savings.

As discussed above, optimizing heat exchangers is costly and complicated. Specifically, optimization of charge and discharge rates of PCM for increasing the energy storage capacity of the TES (including PCMs integrated with fluid-carrying pipes such as heat exchangers (heat exchangers) and heat pipes) depends on simultaneous optimization of several factors such as, without limitation, phase change material properties (e.g., conductivity liquid and solid phase, specific latent thermal energy, specific heat liquid and solid phase); heat exchanger material properties (e.g., tube material, fin material, etc.); fin geometry (e.g., spacing, thickness, topology or arrangement, etc.); tube geometry (diameter, spacing, wall thickness, etc.); heating or cooling system requirements (e.g., temperature of inlet fluid and fluid flow-rate, heating/cooling power available from fluid stream, etc.); varying orientations of high-thermal conductivity materials (e.g., Cu finned tubes, Al finned tubes, and steel plates) in the system; cost of heat exchanger materials per energy stored; distribution of the PCM to enhance the energy charge and discharge rates; required thermal performance of heat exchanger (heat flux and temperature difference between the heat transfer fluid and the PCM ($\Delta T$) affects the charge and discharge times as well as the size of the heat exchanger). Furthermore, most existing TES designs are optimized based on single-tube designs and do not consider how the single-tube designs scale to full heat exchangers. Such simplified models struggle to describe the melting and freezing fronts and correctly predict the state of charge.

The current disclosure describes a high-fidelity 3D finite element modeling that considers accurate results with respect to the effects of the melting and freezing fronts on the available stored energy (while optimizing one or more of the above factors). Moreover, the proposed methods include a multiple-scale 3D finite element modeling approach to design fin-tube heat exchangers that have low-cost latent TES applications and are suitable to couple with TABEs for indoor heating and cooling.

Typically, the PCM material may undergo a solid-liquid phase change and may store/release energy on undergoing a phase change. This process may occur a plurality of times.

The present disclosure therefore relates to a TES system and resulting thermal energy storage. The systems and methods of the present disclosure may be used in a number of technologies that store energy in, for example, a thermal reservoir for later re-use. A particular advantage of using solid-liquid PCM is to balance energy demand between day time and night time. A thermal reservoir may be maintained at a temperature above (i.e. hotter) or below (i.e. colder) than that of the ambient environment. The present disclosure can therefore be used in both a heating and/or a refrigeration system. A particular use of the present invention is in air conditioning units or in central heating systems.

Typically, the TES may comprise at least one bank or a plurality of banks. At least one or plurality of banks may contain one or more heat exchanger means that may permit thermal energy to be transferred (e.g. by conduction and/or radiation and/or convection and/or heat pipe and/or thermal energy transfer indirectly via a thermal energy transfer fluid and/or any other means of thermal energy transfer) to and/or from at least one thermal energy sources and/or sinks. Typically, any thermal energy source/sink within a bank comprises at least some thermal energy storage material in thermal contact (whether directly physically in contact or radiatively in thermal contact or otherwise) with one or more heat exchanger means within the bank. The heat exchanger means may permit thermal energy to be removed from and/or delivered to (by conduction and/or radiation and/or convection and/or heat pipe and/or thermal energy transfer indirectly via a thermal energy transfer fluid and/or any other means of thermal energy transfer) the thermal energy storage material within the bank by transfer to/from at least one thermal energy transfer connection comprising at least one thermal energy transfer medium (including but not limited to thermally conductive metal and/or high thermal conductivity plastic and/or gas and/or refrigerant and/or electromagnetic radiation and/or liquid and/or other heat transfer fluid). The thermal energy transfer medium of the thermal energy transfer connection may be contained within and/or enclosed by and/or directed by one or more pipes and/or other vessels and/or enclosures (which may be closed and/or open, and may be point-to-point in nature and/or form a loop and/or form all or part of a network) to promote and/or assist and/or ensure the thermal energy transfer medium's function to transfer thermal energy from the thermal energy source at one end of the thermal energy transfer connection to the thermal energy sink as the thermal energy transfer medium may be pumped and/or otherwise caused to move by the application of external energy and/or by natural processes (such as but not limited to convection and/or thermosyphon and/or capillary action) in such a way as to promote and/or assist and/or ensure its function to transfer thermal energy from the thermal energy source at one end of the thermal energy transfer connection to the thermal energy sink at the other or vice-versa.

Figure 1B:
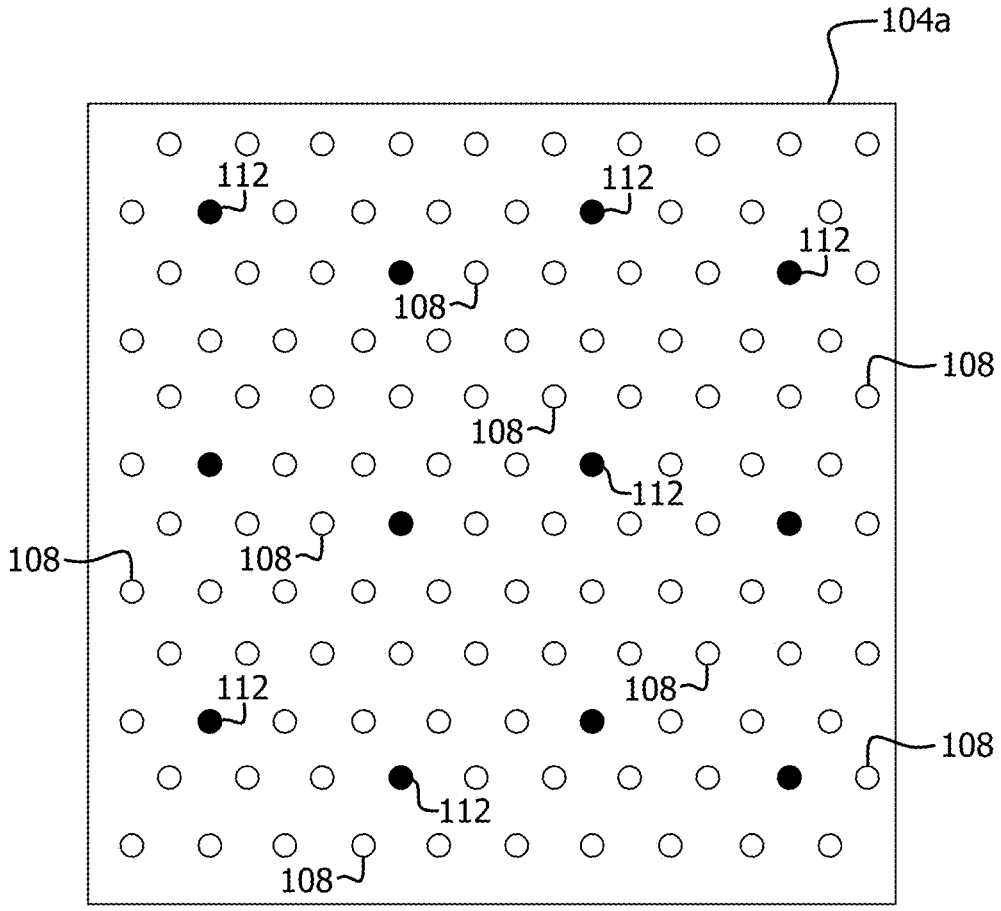
FIG. 1B is a plan view of the heat exchanger of FIG. 1A.

As illustrated in FIG. 1A, a sectional schematic of a tube and fin heat exchanger is shown. FIG. 1B illustrates a plan view of the heat exchanger of FIG. 1A. A typical tube and fin heat exchanger (100) consists of a stack of generally planar metallic fins (120). The fins (120) have a number of collared holes (108) formed therethrough. Optionally, the fins may be sandwiched between two end plates (104*a* and 104*b*) and have corresponding holes as well. When the fins (102) and end plates (104*a* and 104*b*) are stacked, the holes (108) and end plate holes are in axial alignment for receiving a number of tubes (112) through the stack.

The fins may be flat, perforated, serrated, and/or corrugated. Optionally, the fins may include perforations for improving heat exchanger efficiency because the perforations cause an increase in natural convection.

The exchanger 100 can also include a pair of vertically extending headers 113 (*a*) and 113 (*b*) that are parallel and spaced from one another. The headers 113 (*a*) and 113 (*b*) preferably are hollow cylinders formed and welded from sheet aluminum or simply extruded, but could be multiple piece headers formed by welding or brazing if desired. Proximal ends of the tubes 112 are coupled to and are in fluid communication with the headers 113 (*a*) and 113 (*b*) (e.g., via metal tubing or distribution lines). The tubes 112 may be formed by extrusion or may be welded tubes provided with inserts. Optionally, the system may not include headers, and the tubes may be hairpin shaped tubes.

Figure 1C:
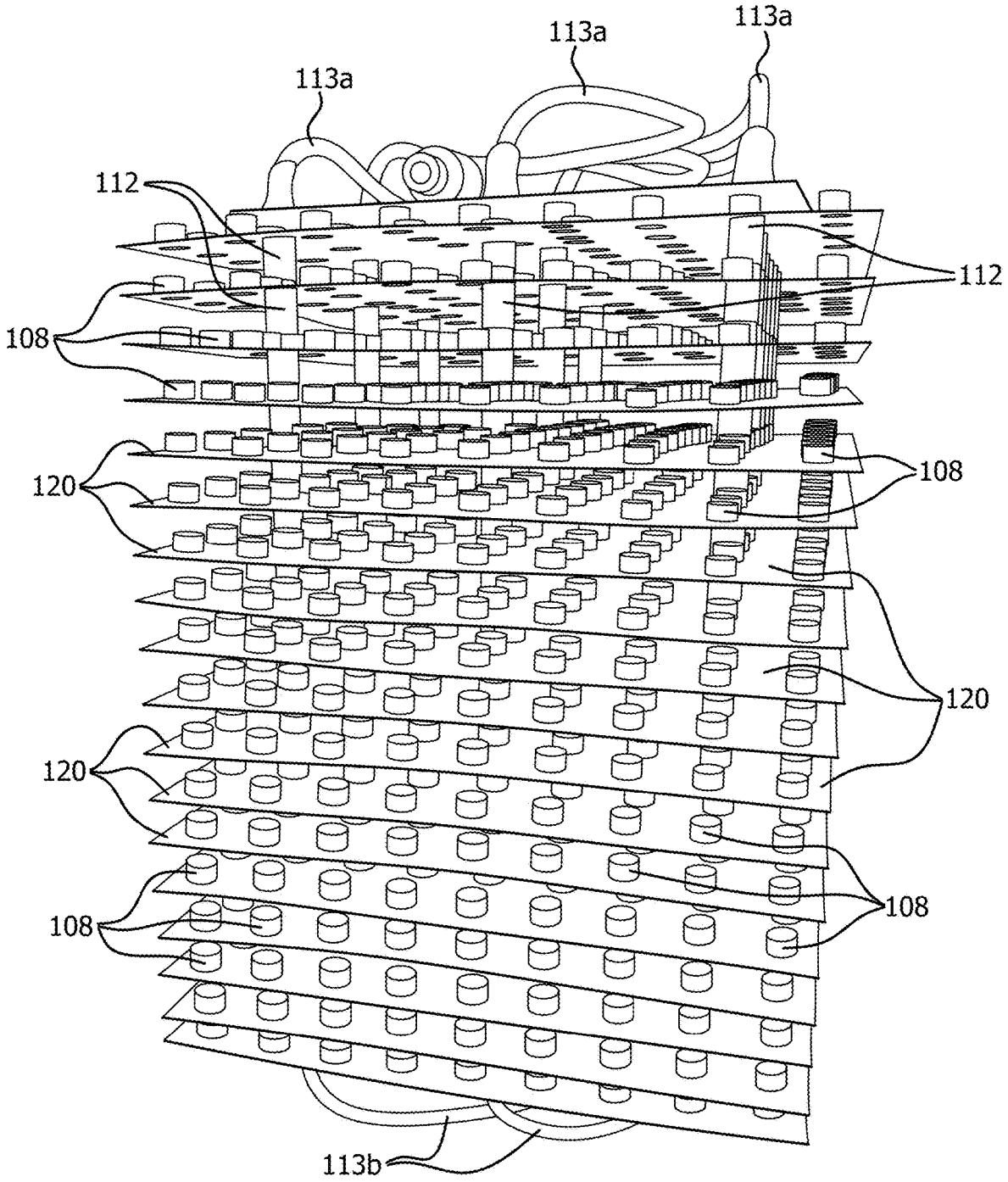
FIG. 1C is an example heat exchanger.
Figure 2D:
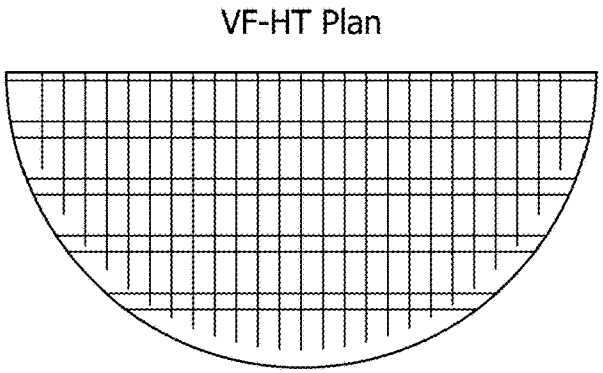
FIGS. 2A-2D illustrate an example schematic of a vertical finned horizontal tube type heat exchanger.
Figure 2C:
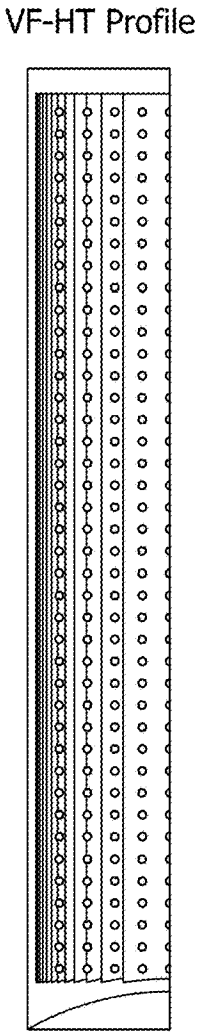
Figure 2B:
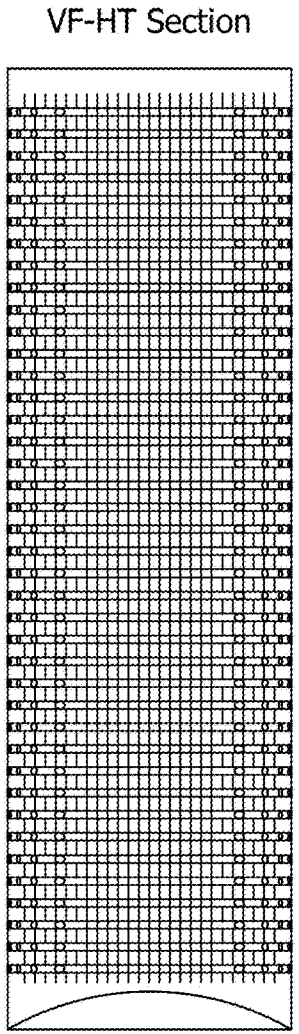
Figure 2A:
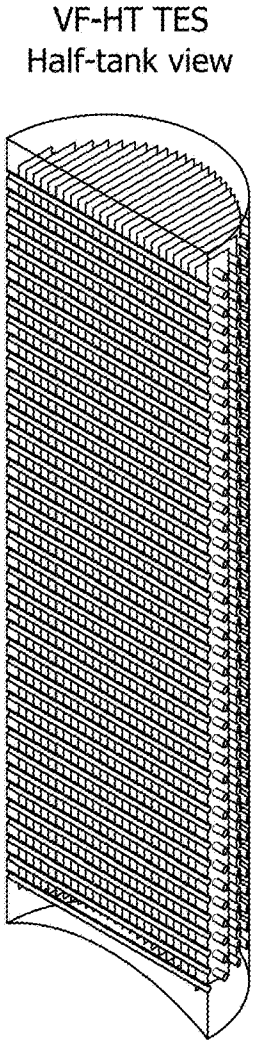
Figure 3A:
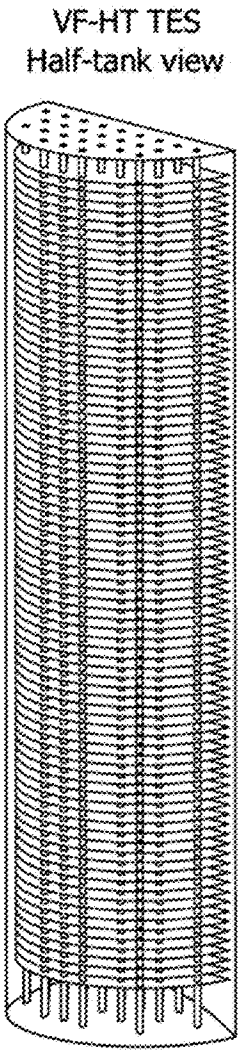
FIGS. 3A-3D illustrate an example schematic of a horizontal finned vertical tube type heat exchanger.
Figure 3B:
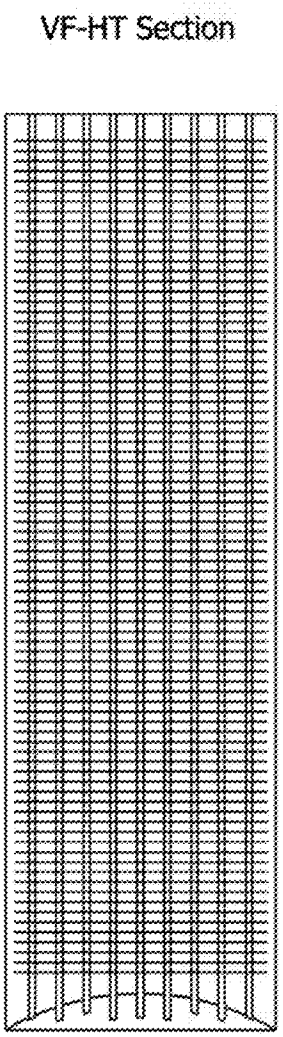
Figure 3C:
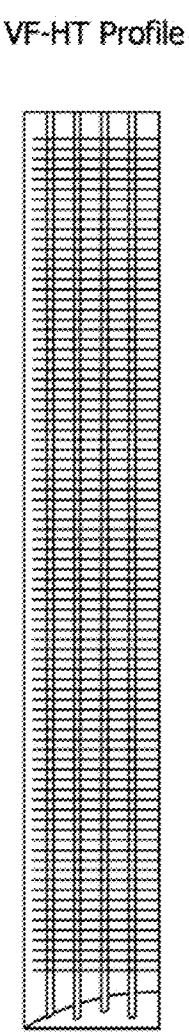
Figure 3D:
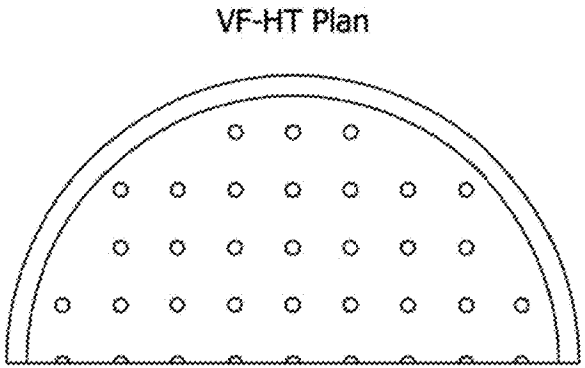
Figure 4D:
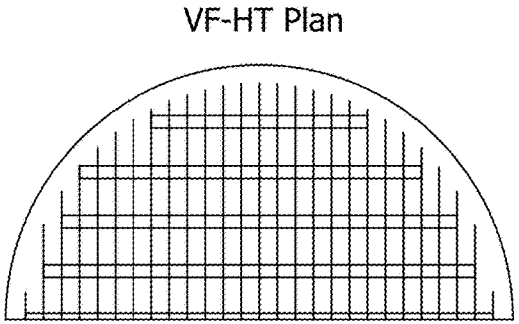
FIGS. 4A-4D illustrate an example schematic of a conformal vertical finned horizontal tube type heat exchanger.
Figure 4B:
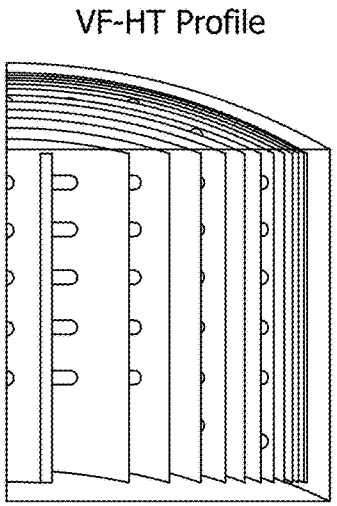
Figure 4C:
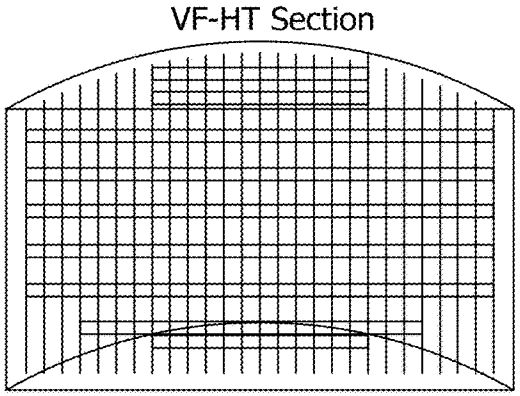
Figure 4A:
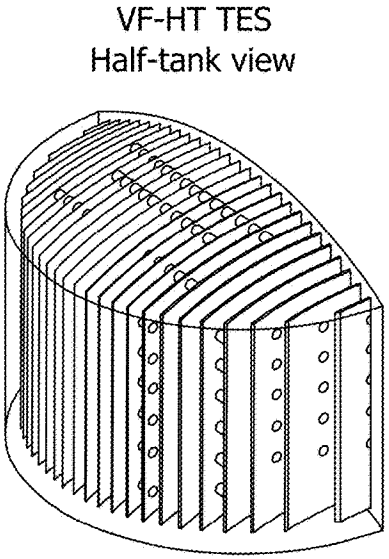

FIG. 1C illustrates an example heat exchanger corresponding to the schematic shown in FIG. 1A. The exchanger 100 is at least partially submerged in a PCM material contained within a storage tank (not shown here). The storage tank may be thermally insulated. One or more fluid flow loops may be formed between the tubes and the header in which a heat exchanger fluid flows through the tubes 112 (e.g., forced by convection during the melting process). In this process, hot fluid heats the PCM which melts and stores the heat. During the solidification process, the PCM solidifies and the stored heat is delivered to the cold fluid in the tubes.

It should be noted that the heat exchanger may be a vertical fin and horizontal tube design (as shown in FIGS. 2A-2D) or a horizontal fin and vertical tube design (as shown in FIGS. 3A-3D). Optionally, the vertical fin and horizontal tube design may include conformal fins (e.g., sheets that conform to the shape of the storage tank) as shown in FIGS. 4A-4D.

Optimizing the charging and discharging of a PCM inside a shell-and-tube heat exchanger operating as a TES device requires investigating complicated thermofluid processes. The following disclosure describes systems and methods for optimizing the design of the heat exchanger system described above (or other heat exchangers) for using PCMs. Most literature studies investigating the thermal performance of PCM metal composites for thermal storage have focused on employing high-conductivity materials such as Cu finned tubes, Al finned tubes, and steel plates. However, such studies on PCM composite integrated with heat exchangers do not include the cost of the heat exchanger materials per energy stored and also optimizes the distribution of the PCM to enhance the energy charge and discharge rates. Furthermore, the design of the PCM heat exchanger system depends on its thermal performance because the heat flux and temperature difference between the heat transfer fluid and the PCM ($\Delta T$) affects the charge and discharge times as well as the size of the heat exchanger. Most conventional single-phase energy storage systems have low $\Delta T$ values of the heat transfer fluid in the tubes to achieve high efficiency, and PCM thermal storage systems often require larger $\Delta T$ values to access the high-energy storage density material. Finally, current design optimizations are based on single-tube designs and do not consider how the single-tube designs scale to full scale heat exchangers. Such simplified models struggle to describe the melting and freezing fronts and correctly predict the state of charge.

The current disclosure describes a 3D finite element modeling (FEM) approach to optimize the design of a PCM heat exchanger taking into consideration both cost and thermal performance. The output design is suitable to couple with TABEs for indoor heating and cooling.

Figure 5:
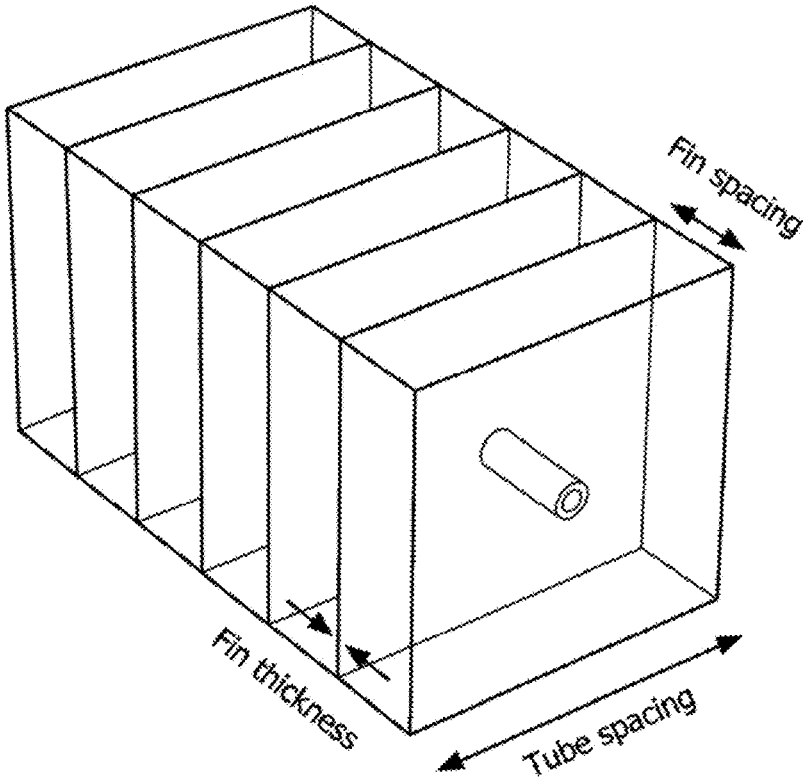
FIG. 5 illustrates example parameters to be optimized in a heat exchanger.

The system and method may generate an optimized PCM heat exchanger 100 for a given design objective such as cost and thermal performance, and/or other design objectives. These may, in turn, depend on factors such, as without limitation, materials (fin, tube, PCM, etc.) and geometry (e.g., fin topology, fin spacing, fin thickness, tube topology, tube spacing, tube wall thickness, and tube diameter). For example, a heat exchanger which may be described to have an initial geometry "G". The initial geometry "G" may be changed to an optimized geometry using the optimization system and method disclosed herein. FIG. 5 illustrates example geometrical dimensions that may be optimized using the methods and system of this disclosure.

As described in greater detail below, the system and method advantageously use various geometrical parameters (e.g., fin topology, fin spacing, fin thickness, tube topology, tube spacing, tube wall thickness, and tube diameter) and material properties (e.g., conductivity, temperature glide, specific latent thermal energy, and specific heat) as design variables for efficiently generating an optimized design model of a heat exchanger. The system and method may be implemented for generating an optimized PCM heat exchanger of any size, shape, and configuration, and is not limited to a heat exchanger as shown in FIG. 1. Furthermore, the system and method may be implemented for generating an optimized design model of a heat exchanger that may be subjected to any one of a variety of different heating and cooling conditions for various applications.

Figure 6:
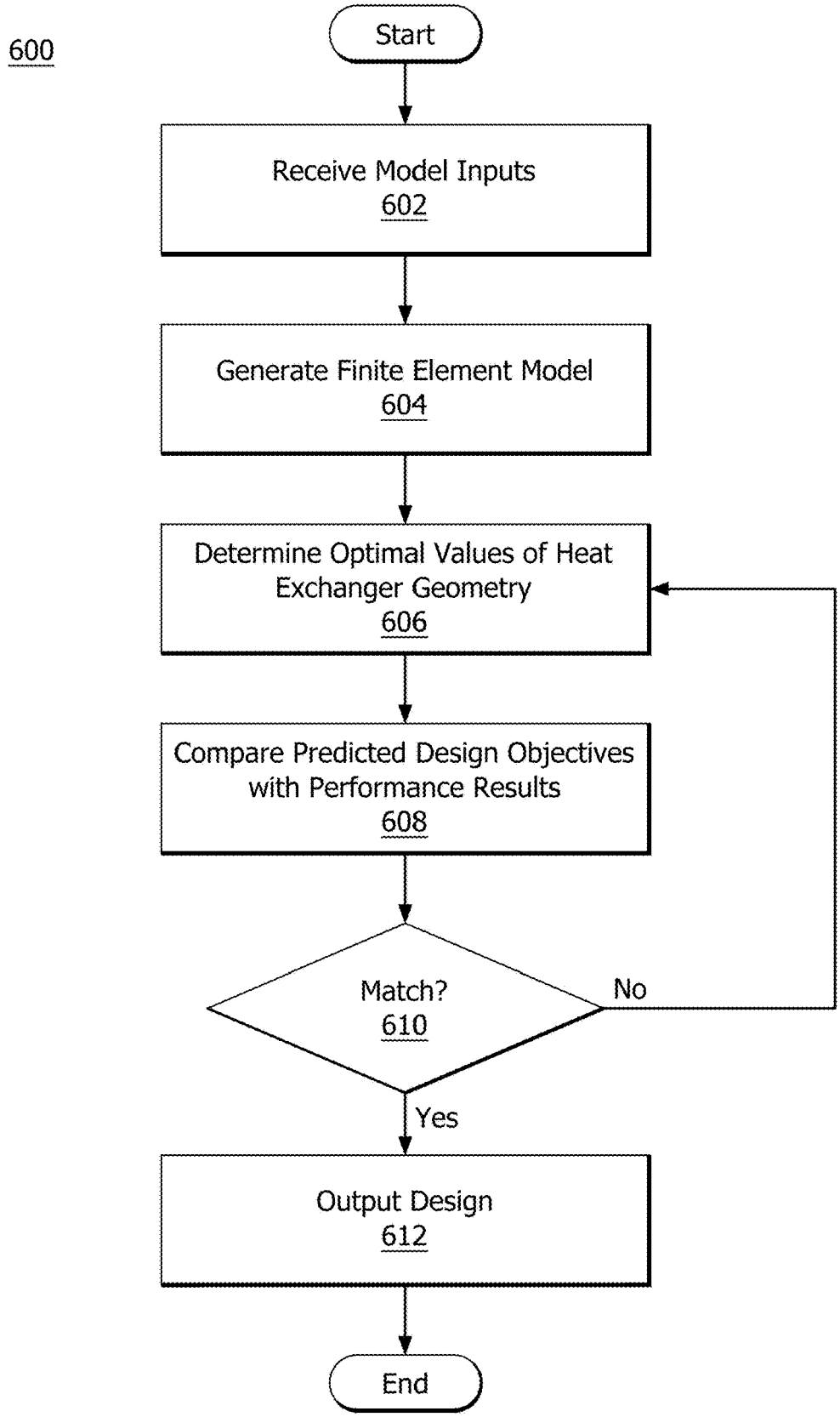
FIG. 6 illustrates a flow chart of an example method of performing heat exchanger design optimization.

Referring to FIG. 6, the method 600 of generating an optimized design model of a heat exchanger may be implemented in a finite element analysis program or solver such as COMSOL™ Multiphysics, Nastran™, Abaqus™, OptiStruct™, Genesis™, or any other suitable finite element program. The method may include at 602 receiving or determining modeling inputs including an initial set of heat exchanger parameters and PCM parameters of an initial exchanger design having an initial geometry G. For PCMs, the parameters may include phase change temperatures, temperature glides, latent heats of fusion, thermal conductivities, specific heats, and densities in liquid and solid states were experimentally measured or obtained from manufacturers. The heat exchanger parameters may include candidate heat exchanger materials (e.g., copper, aluminum, steel, and cross-linked polyethylene (PEX), etc.), and their associated unit costs, thermal conductivities, specific heats, and densities were obtained from manufacturers.

For example, Table 1 illustrates heat exchanger material properties and costs per unit mass ($/kg):

TABLE 1

| Material | Cost ($/kg) | Thermal conductivity (W/m · K) | Specific heat (kJ/kg · K) | Density (kg/m$^3$) |
|---|---|---|---|---|
| Cu | 8.16[a] | 390 | 0.385 | 8.960 |
| Al | 2.36[b] | 200 | 0.890 | 2.700 |
| Steel | 0.93[c] | 20 | 0.420 | 7.850 |
| PEX | 1.10[d] | 0.41 | 0.550 | 0.939 |

Table 2 illustrates PCM materials and properties:

TABLE 2

| PCM | PCT[b] (° C.) | LHF[c] (kJ/kg) | TC[b] (L) (W/m · K) | TC[b] (S) (W/m · K) | Glide[c] (° C.) | Sp heat[b] (L) (kJ/kg · K) | Sp heat[b] (S) (kJ/kg · K) | Density[b] (L) (kg/m$^3$) | Density[c] (S) (kg/m$^3$) |
|---|---|---|---|---|---|---|---|---|---|
| PT18 | 18 | 171 | 0.14 | 0.18 | 5 | 1.8 | 1.8 | 860 | 950 |
| PT23 | 23 | 180 | 0.14 | 0.18 | 9 | 1.8 | 1.8 | 830 | 857 |

TABLE 2-continued

| PCM | PCT[b] (° C.) | LHF[c] (kJ/kg) | TC[b] (L) (W/m · K) | TC[b] (S) (W/m · K) | Glide[c] (° C.) | Sp heat[b] (L) (kJ/kg · K) | Sp heat[b] (S) (kJ/kg · K) | Density[b] (L) (kg/m$^3$) | Density[c] (S) (kg/m$^3$) |
|---|---|---|---|---|---|---|---|---|---|
| HS22P | 22 | 185 | 0.54 | 1.09 | 12 | 3.04 | 2.2 | 1540 | 1,840 |
| HS24P | 24 | 185 | 0.54 | 1.09 | 4 | 3.04 | 2.2 | 1540 | 1,820 |

The heat exchanger geometry including optimal tube size, tube spacing, fin thickness, and fin spacing are the design variables of the optimization method for different heat exchanger materials, PCMs, and temperature differences between the tube surface and the PCM.

In the present disclosure, the optimization method is illustrated in the context of the heat exchanger shown in FIGS. 1A-1C. In the present example, the optimization method and system is implemented to optimize the heat exchanger design for achieving PCM discharge times suitable for building TES (e.g., 4-5 h) with fin-tube heat exchanger designs at costs <$26/kWh, even when the temperature difference (5.56° C.) between the heat transfer fluid and the PCM phase change temperature is small. For example, heat exchanger designs that meet the following design objectives may be optimized: (1) the PCM uses 90% of the space in the tank, (2) 75% of the latent thermal energy is charged and discharged in 3 h and 90% is charged and discharged in 4 h, (3) a ΔT of no more than 5.6° C. is maintained between the heat transfer fluid and the phase change temperature, and (4) the heat exchanger components cost less than about $15/kWh. Other design considerations may similarly be used. For example, while a ΔT of 5.6° C. was chosen to meet the performance requirements discussed, higher and lower ΔT values may be used.

Referring again to FIG. 6, at 604, the method may include generating a finite element model of the heat exchanger for analysis in a finite element analysis program. In some examples, the finite element model may be generated based on a computer-aided-design model (e.g., based on experimental or simulated data from literature) of the initial heat exchanger geometry to be optimized. Alternatively, the finite element model may be manually constructed. When, however, there is no need to newly prepare the model as in the case where a model of a separate heat exchanger of the same model has been prepared in the past, it is not always necessary to execute the finite element model generation procedure. The model is, for example, a model of the heat exchanger formed by a plurality of meshes.

Figure 7A:
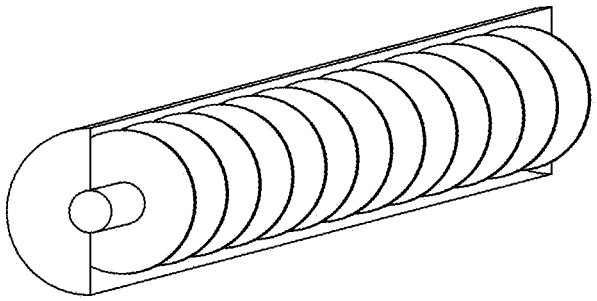
FIG. 7A illustrates a finite element model of an annular fin design.

An example 3D finite element model at unit scale (i.e., including single tube annular fin design) is shown in FIG. 7A. The design elements (as discussed above with respect to FIG. 5) of the model can include fin spacing, fin thickness, tube spacing, and tube diameter. Other design elements are within the scope of this disclosure.

Figure 7B:
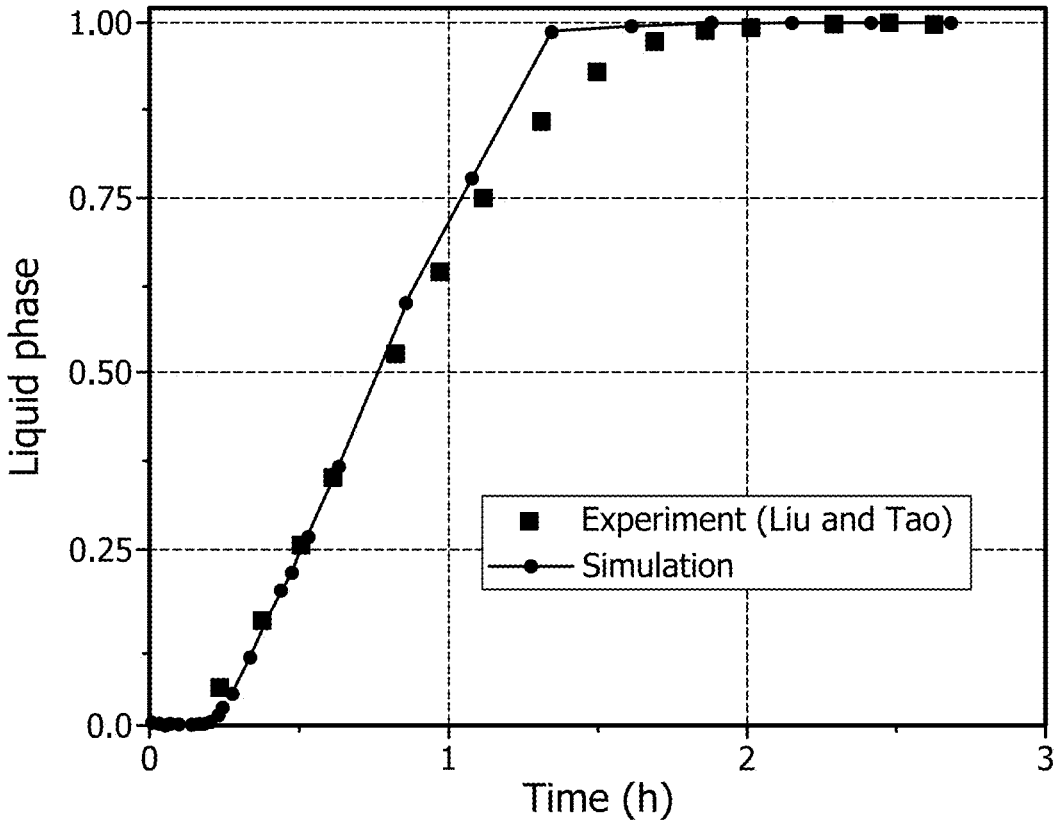
FIG. 7B illustrates model validation by comparing simulated results and experimental data.

Optionally, the model may be validated using any now or hereafter know model validation methods (e.g., using experimental data). For example, FIG. 7B illustrates model validation of the model shown in FIG. 7A by comparing simulated results (from the model) to experimental data. The results indicate that the model matches with the experimental data up to 75% liquid phase and starts to deviate at 90% liquid phase, mainly because the model does not consider heat lost or gained from the ambient and natural convection in the system. The impact of natural convection at these melt fractions is expected to be significant. Natural convection was purposely omitted at this stage of the research because the natural convection patterns of a multirow heat exchanger are expected differ from those of a single tube. Furthermore, container aspect ratio and PCM viscosity also affect the natural convection process.

Step 606 may include determining, using an optimizer (e.g., embedded into a finite element analysis program) operating on the finite element model, optimum values for the design elements (e.g., fin spacing, fin thickness, tube spacing, and tube diameter) based on the PCM parameters and/or heat exchanger material parameters, and the initial exchanger geometry. The optimizer and the finite element analysis may determine the optimum values for the fin spacing, fin thickness, tube spacing, and tube diameter that best matches the above discussed design objectives (e.g., cost, PCM charge/discharge rates, thermal performance, etc.), and other design rules and/or manufacturing rules.

In the present disclosure, prior to optimization, the method may include defining the design objectives, and entering the design rules and the manufacturing constraints into the finite element analysis program. For example, the design objectives may be defined in terms of PCM charge/discharge times, PCM storage tank utilization, cost (being defined by materials used), etc.

As discussed, the optimization process may be based on certain design rules. The design rules may include design parameter constraints to facilitate and/or converge the optimization process. For example, design rules may include setting limits on maximum increases/decreases in values of the design parameters or parameters between each iteration (e.g., no more than 5% value change between iterations), halting the optimization process when there is less than a predetermined change (e.g., less than 1/10th percent) in the design variables between iterations, setting the maximum number of iterations (e.g., 500), and other parameters.

The method may further include entering manufacturing constraints into the optimizer (e.g., the finite element analysis program or solver). For example, the manufacturing constraints may include a requirement that tube spacing be maximized (i.e., the number of tubes may be minimized) because tubes are generally more expensive than fins (because of pressure requirements). Another manufacturing constraint may include maximizing the fin spacing based upon the determined maximum allowed tube spacing. Another example manufacturing constraint may include minimizing the tube diameter in order to increase the Reynolds number and hence improve thermal performance. Optionally, manufacturing constraint may include the inclusion of twisted tape inserts to optimize the manufacturing in order to enhance heat transfer in tubes by modifying the flow channel of the fluid within. When twisted tape is inserted, it causes a turbulent, transverse flow inside the tube. This kind of flow activates the fluid particles and forces heat transfer through both convection and conduction. Another example manufacturing constraint may include minimizing the fin thickness (e.g., when fin material conductivity is greater than about 20 W/m·K). Optionally, the fins may be perforated to increase natural convection. As may be appreciated, any number of manufacturing constraints may be included in the optimization process.

At 608, the predicted design objectives of the model are compared to performance results of the modeled exchanger (e.g., the performance results being obtained using actual experimental performance of the modeled exchanger and/or stimulated performance). If the predicted design objectives and performance results do not match (i.e., more than a threshold difference exists), then the model may be modified in a manner thought to increase agreement between design objectives and performance results, and a new computation may be performed with the modified model. Steps 604-606 may then be repeated until satisfactory agreement is obtained. For example, the initial model may be corrected (e.g., initial geometry/design elements updated) for reflecting the actual measurement information of the evaluated portion in the finite element model and generating a correction model (e.g., by changing the inter distance in the mesh model) obtained through the correction of the model.

If the predicted design objectives and performance results match (i.e., less than a threshold difference exists), the modeled design parameters may be output (612).

Optionally, the finite element modeling approach discussed above may be used to scale the design of the heat exchanger. For example, finite element modeling may be used with empirical parameters for the PCM's specific latent heat, PCTR, thermal contact resistance, and thermal power load shape on the unit scale to determine the effects of fin-tube heat exchanger design parameters (i.e., fin spacing, fin thickness, tube spacing, and tube diameter) on the discharge behavior of the PCM. This may be done to identify materials that enable fin-tube heat exchanger designs to achieve high performance at low cost and high utilization of low-conductivity, commercially available PCMs. Additional hypothetical PCMs may be analyzed at very low (<0.2 W/m·K) and relatively high (>0.5 W/m·K) thermal conductivities to bound the practical simulations.

For example, to study the effect of heat exchanger materials and configurations on the discharge fractions of PCMs, various heat exchanger configurations may be studied and evaluated for different PCM and/or heat exchanger materials. In addition, the fin thickness, tube spacing, and fin spacing may be varied.

The unit-scale design may be used as the initial design for a larger heat exchanger design (e.g., 0.0189 $m^3$ (5 gal) medium-scale TES system). The medium-scale design results may be used as the initial design for a still larger heat exchanger design (e.g., a large-scale 0.189 $m^3$ (50 gal) design)—and, so on by modeling with empirical considerations that significantly affected performance (e.g., PCM enthalpy and PCTR).

In an example implementation, a heat exchanger design was optimized to reach 75% discharge in 3 hours and 90% discharge in 4 hours with readily available PCMs. The optimum heat exchanger had one or more of the following geometrical properties (as ratios):

i.

$$\frac{\text{Fin spacing}}{\text{tube space}} = 0.1 \text{ to } 0.2$$

ii.

$$\frac{\text{Fin spacing}}{\text{fin thickness}} = 2.3 \text{ to } 125$$

iii.

-continued $$\frac{\text{Fins spacing}}{\text{tube diameter}} = 0.9 \text{ to } 2$$

iv.

$$\frac{\text{Fin spacing}}{PCM \text{ conductivty}} = 0.5 \text{ to } 7.5$$

v.

$$\frac{\text{Fin spacing (inch)}}{PCM \text{ specific latent heat } \left(\frac{\text{kJ}}{\text{kg}}\right)} = 0.0042 \text{ to } 0.0006$$

vi.

$$\frac{\text{Fin spacing (inch)}}{PCM \text{ volumetric latent heat } \left(\frac{\text{kJ}}{\text{m}^3}\right)} = 0.0000047 \text{ to } 0.0000006$$

The dimensions were optimized as follows. The fin spacing may be about 0.75 inch to about 0.14 inch; the fin thickness may be about 0.006 inch to about 0.06 inch; the tube spacing may be about 2 inches to about 4 inches; and/or the tube diameter may be about 0.375 inch to about 0.16 inch.

EXAMPLE

Unit Scale Heat Exchanger

Figure 8:
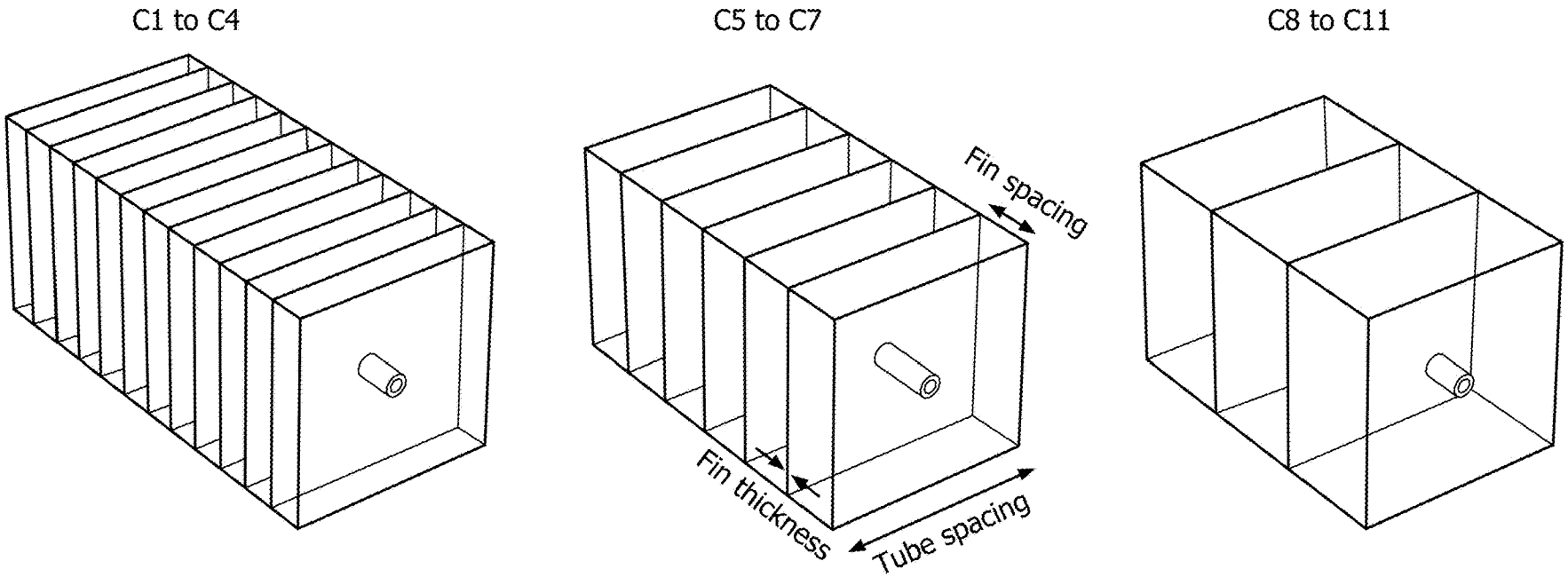
FIG. 8 illustrates different designs based on varying fin numbers and fin spacing during model optimization.

In this example, a mass and heat exchanger that is designed according to the principles taught herein. Specifically, for designing the unit scale heat exchanger, the effect of heat exchanger materials and configurations on the discharge fractions of PCMs, 11 heat exchanger configurations were studied for the four PCMs and four heat exchanger materials. In addition, the fin thickness, tube spacing, and fin spacing were varied. Specifically, two fin thicknesses (0.397 and 0.974 mm), three tube spacings (85.7, 100, and 120 mm), and three fin spacings (15, 30, and 60 mm) were used. The detailed characteristics for each case are described in Table 3. Because of the fin spacing, 11 fins were used in cases C1-C4, 5 fins were used in C5-C7, and 2 fins were used in C8-C11, as shown in FIG. 8.

TABLE 3

| PCM | Cases | Fin material (—) | Tube material (—) | Fin thickness (mm) | Tube spacing (mm) | Fin spacing (mm) |
|---|---|---|---|---|---|---|
| PT20/ | C1 | Al | Al | 0.794 | 85.7 | 15 |
| PT23/ | C2 | Cu | Cu | 0.397 | 85.7 | 15 |
| HS22P/ | C3 | Cu | Cu | 0.794 | 85.7 | 15 |
| HS24P | C4 | Steel | PEX | 0.794 | 85.7 | 15 |
| | C5 | Al | Al | 0.794 | 100 | 30 |
| | C6 | Cu | Cu | 0.794 | 100 | 30 |
| | C7 | Steel | PEX | 0.794 | 100 | 30 |
| | C8 | Al | Al | 0.794 | 120 | 60 |
| | C9 | Cu | Cu | 0.794 | 120 | 60 |
| | C10 | Steel | PEX | 0.794 | 120 | 60 |
| | C11 | Steel | PEX | 0.397 | 120 | 60 |

As shown in FIGS. 9A-9D, the performance requirements or objectives were met by heat exchanger cases C1-C3 (i.e., they took up less than 10% of TES storage volume and the temperature differences between the phase change temperatures and the thermal sources/sinks were less than 5.6° C.). Designs C1-C3 all had fin spacing of 15 mm, tube spacing of 85.7 mm, and either Cu or Al as the fin and tube materials. The larger fin spacings (i.e., 30 and 60 mm) and tube spacings (i.e., 100 and 120 mm) significantly reduced the discharge fraction. Fin thickness had a minimum influence on discharge performance, and 0.397 mm was adequate because the fin's thermal conductivity (even for the steel fins) is much larger than those of PCMs. With >0.397 mm fin thickness, the computation time increased significantly without a significant improvement in the performance of the TES system. Switching the tube and fin materials from Cu and Al to PEX and steel also significantly reduced the discharge fraction (see C4 in FIGS. 9A-9D). This is because PEX has a very low thermal conductivity compared with the metal tubes.

Compared with organic PCMs (PT20 and PT23), the discharge fractions of inorganic salt hydrate PCMs were slightly lower because of their higher energy densities. However, the target discharging requirements (i.e., 75% at 3 h and 90% at 4 h) were still met because of the higher thermal conductivities of salt hydrates. The volumetric energy densities of the salt hydrate PCMs are almost twice those of the organic PCMs, and the total latent energy stored per unit volume is about 180% of that of the organic PCMs. Therefore, the designs for organic and inorganic PCMs also met the performance goals.

As discussed above, the optimized design for the unit scale heat exchanger (e.g., C1-C3, and PT23 PCM) may be used as the initial design for a larger scale hear exchanger design optimization. For example, the unit-scale model with 30 mm fin spacing was placed inside the 0.0189 $m^3$ (5 gal) tank and scaled up to include multiple tubes. In these medium-scale designs, artificially high-conductivity PCMs (i.e., thermal conductivities of >0.5 W/m-K) were studied. These represented PCMs doped with a high fraction of high-conductivity materials (e.g., metals or graphite).

Figure 10A:
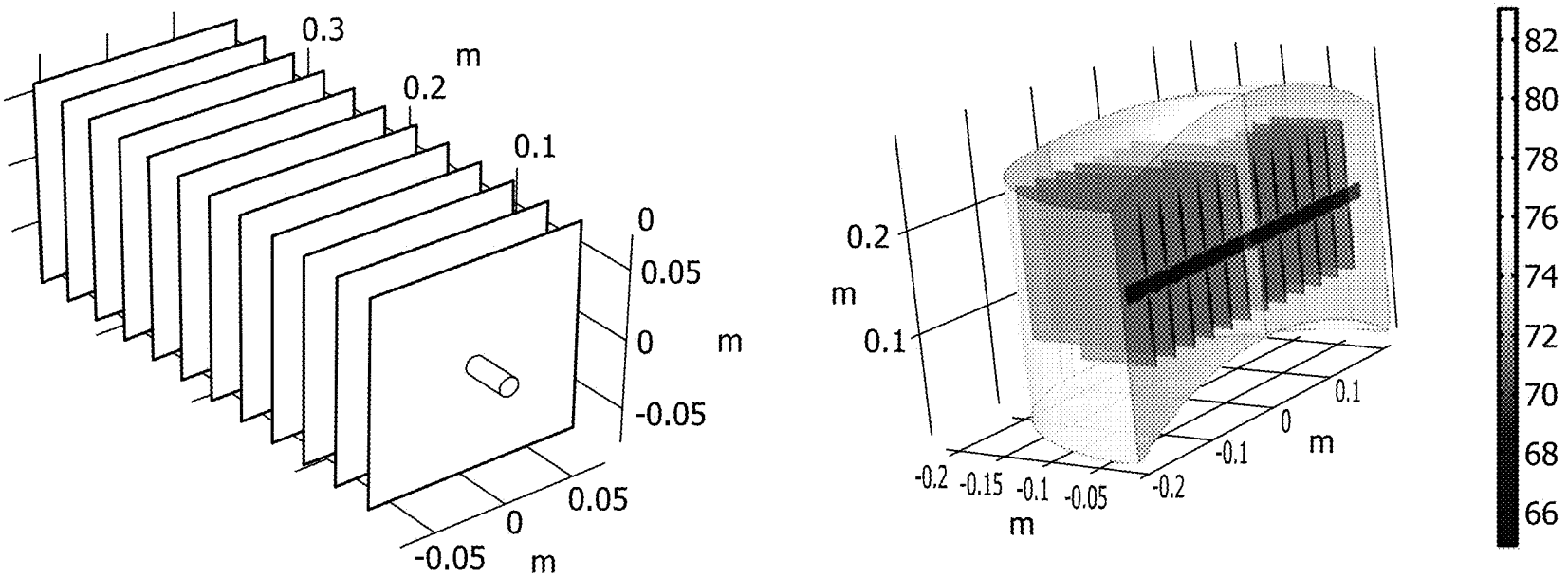
FIG. 10A illustrates the initial medium-scale HX design with fins.
Figure 10B:
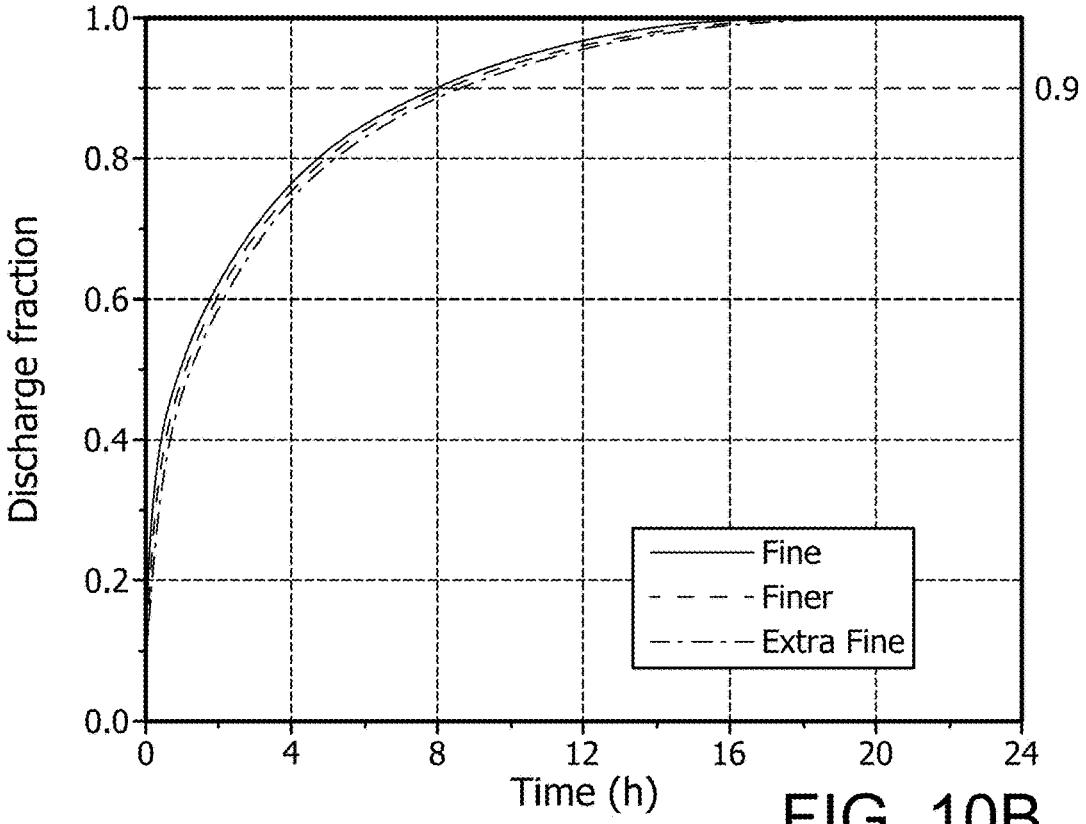
FIG. 10B illustrates the corresponding results of the mesh sensitivity study for a PCM with thermal conductivity of 5 W/m·k.
Figure 10C:
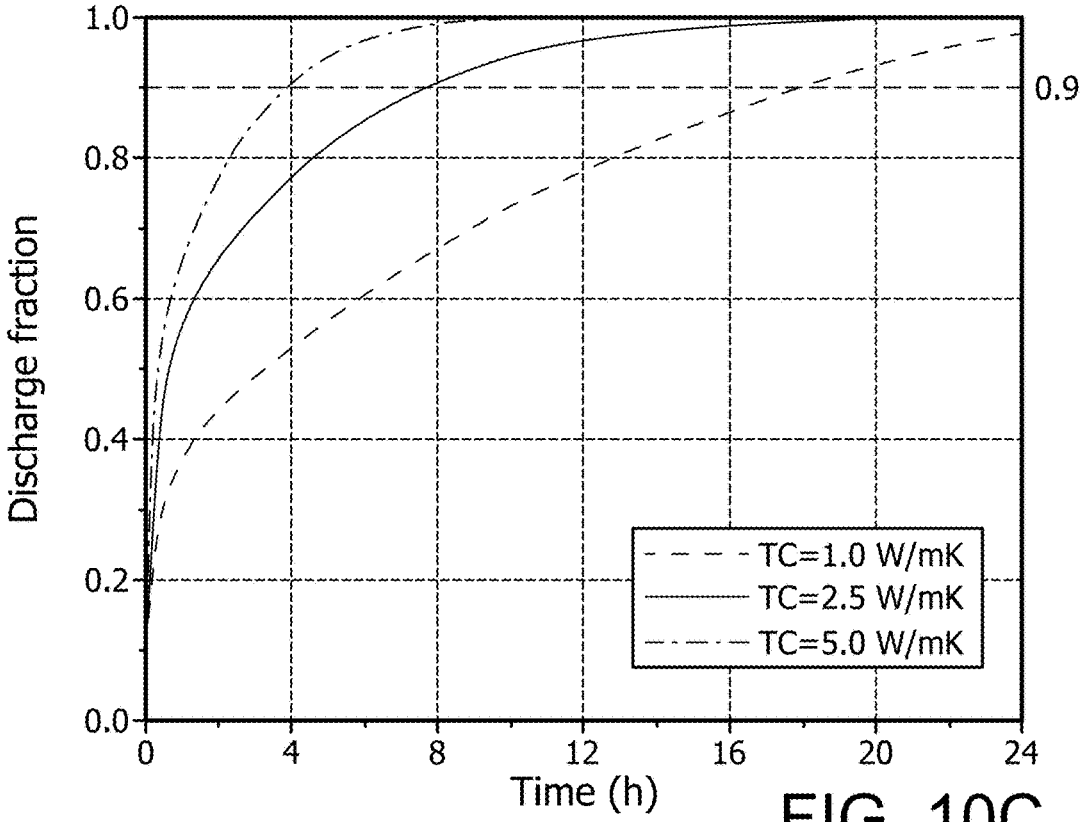
FIG. 10C illustrates volume fraction change of PCM phases as a function of time for PCMs with different thermal conductivities. The targeted discharging requirements is indicated by red dashed lines.

Medium Scale Heat Exchanger (0.0189 $m^3$ (5 gal)):

For example, the first heat exchanger model (or design) was configured with the unit-scale model tube inside a tank as shown in FIG. 10A. Mesh sensitivity studies were conducted to ensure the accuracy of the results at all scales, as shown in FIG. 10B. Three tetrahedra finite element meshes (fine mesh, finer mesh, and extra fine mesh) were used to determine the effect of discharge fraction of reducing the mesh size. The fine mesh comprised 17,210 elements, the finer mesh comprised 31,986 elements, and the extra fine mesh comprised 92,743 elements within a 0.0189 $m^3$ tank (the volume of a nominal 5 gal hot-water tank). The finite elements included tetrahedra-shaped elements, triangle-shaped elements, edge elements, and vertex elements. The fine mesh satisfied the convergence requirements (<3% error in discharge fraction at any time) of the adaptative time step solver at a solver step length of 18 s and the results were similar when adding elements, which indicated a mesh-independent solution. In addition, three thermal conductivities of hypothetical PCMs were analyzed as shown in FIG. 10C. A high-thermal conductivity (5 W/m·k) PCM was required to achieve 90% discharge in 4 h for a single tube-and-fin design. The discharge rate decreased significantly because the fins did not reach the corners of the tank, the 30 mm space between fins was too large, and a single tube was insufficient for TES storage volumes larger than the fin incorporated. These results indicate that the initial model of the heat exchanger needed to be further optimized to have more complex geometries to increase its surface area, to match the tank shape, and to have fin spacings less than 30 mm for lower-conductivity PCMs. The results also suggested that without a fin structure that fits the form of the tank, very high-thermal conductivity PCMs or PCMs doped with high-conductivity material that degrades the total storage density were required.

Figure 11A:
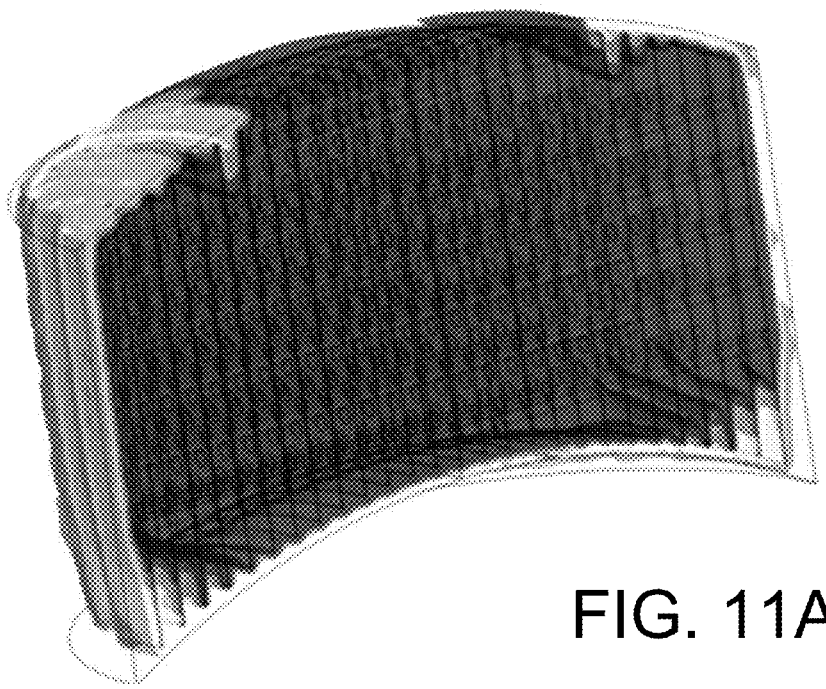
FIG. 11A illustrates the conformal HX design with 27 fins and 27 tubes.
Figure 11B:
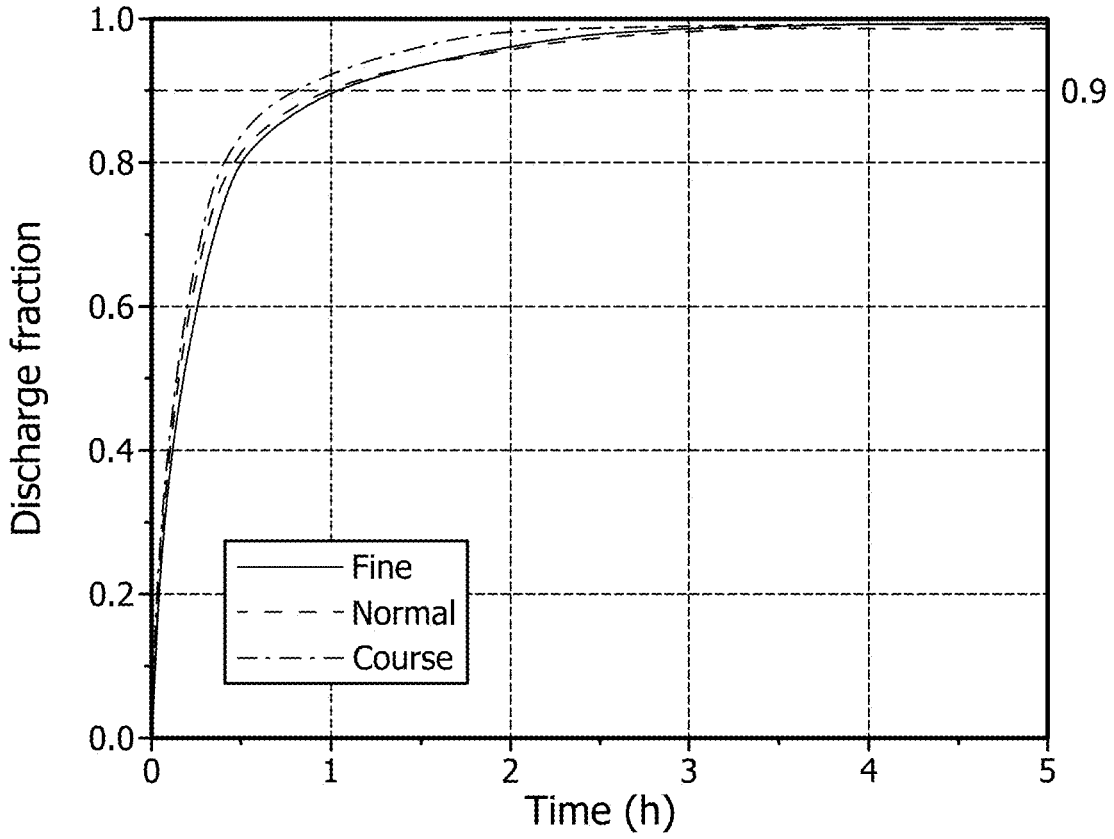
FIG. 11B illustrates mesh sensitivity study results of a PCM with thermal conductivity of 1 W/m·K.

The second model (or design) was created by increasing the number of heat exchanger fins and tubes to 27 each, as shown in FIG. 11A. The volume taken up by the heat exchanger was 9.4% of the storage area for the PCM, a relatively small volume. After being scaled down from field evaluation data of the TABE, the design had an average thermal power of 8 W, assuming a storage size of 0.0189 $m^3$ (5 gal). It was assumed that all the tubes were connected in parallel and that the in-tube fluid flow rate was large enough to allow the tubes to reach isothermal status. Mesh sensitivity studies were also conducted to determine a suitable mesh size. The results in FIG. 11B show that fine and normal mesh sizes yielded approximately the same volume fractions of change. The mesh size (i.e., the distance between the finite elements) was automatically chosen in COMSOL based on the geometry and physics. Different mesh sizes lead to a large difference in the number of finite elements. Reducing the mesh size (e.g., from normal to fine mesh) usually doubles or triples the computation time, suggesting the mesh spacing decreases by at least a factor of two at each scale of the mesh (e.g., coarse, normal, fine, finer, extra fine). The mesh sensitivity studies indicated that normal-sized mesh could be used. In addition, the results in FIG. 11B showed little to no difference between fine, finer, and extra fine mesh sizes for this tank and heat exchanger geometry. This confirmed that the normal mesh size was adequate for adding more tubes and fins in the simulation.

Figure 11C:
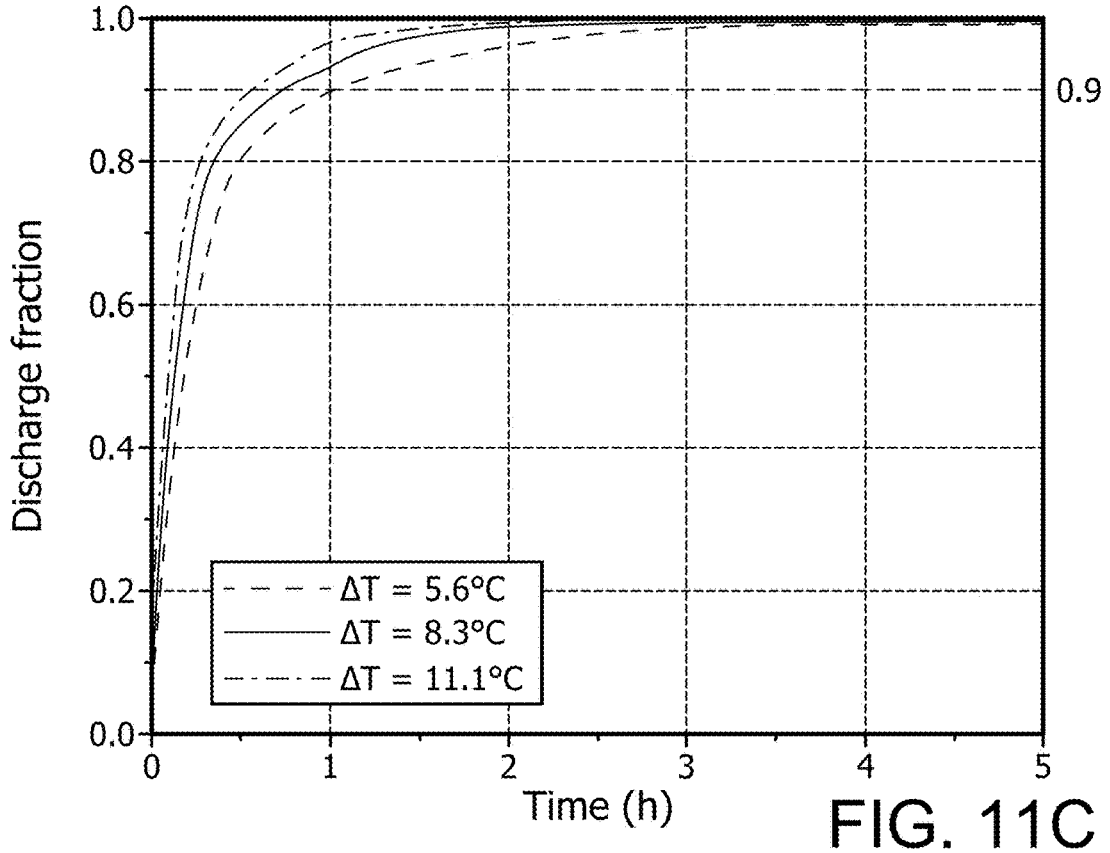
FIG. 11C illustrates temperature difference study for volume fraction change of a PCM with thermal conductivity of 1 W/m·K.
Figure 11D:
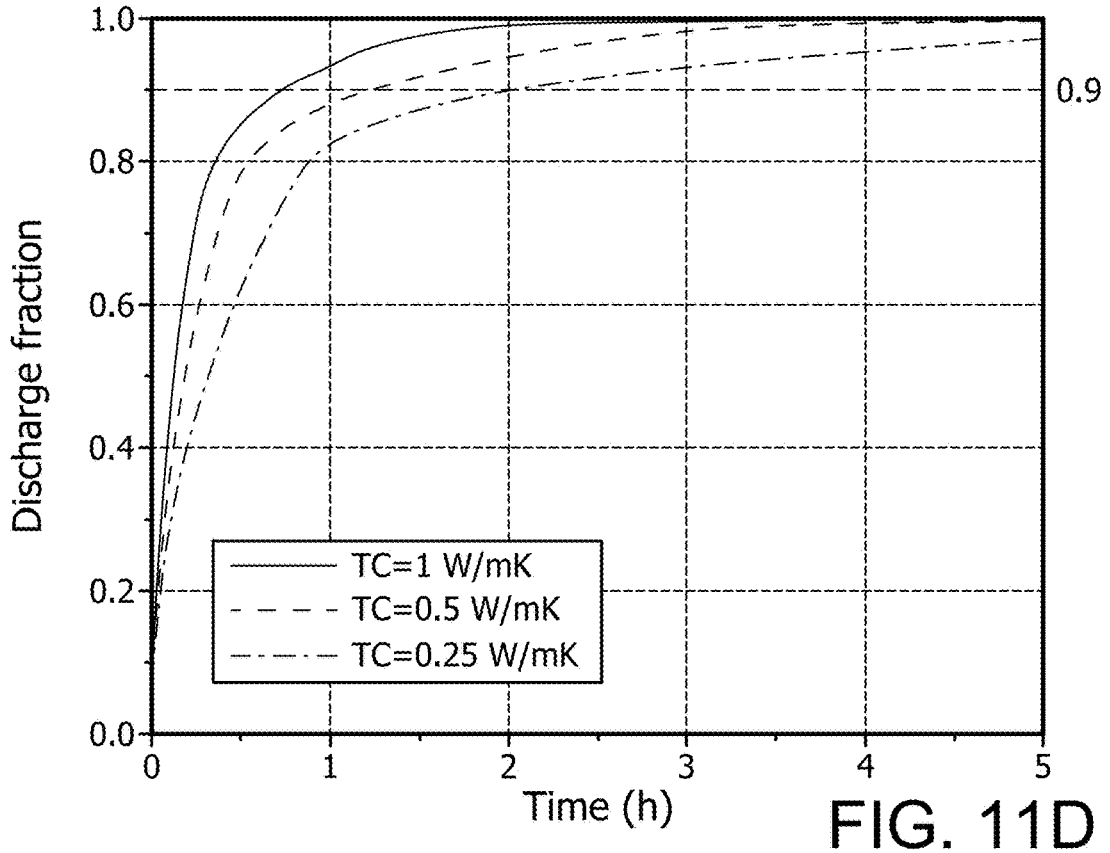
FIG. 11D illustrates volume fraction changes of PCM phases as functions of time for PCMs with different thermal conductivities with an assumed temperature difference of 8.3° C. The red dashed lines show the 90% discharge requirement.

Two parameters were studied in this model to determine their effects on the discharge fraction of PCM: the temperature difference between the tube's wall surface temperature and the initial temperature of the PCM as well as the thermal conductivity of the PCM. FIG. 11C presents the volume fraction phase changes of the PCM when the temperature differences ($\Delta T$) were set to 5.6° C., 8.3° C., and 11.1° C. Temperature difference had a relatively moderate influence on the discharge fraction change of PCM when the thermal conductivity of the fin was high (1 W/m·k) and the spacing was small enough such that PCM conductivity was not a limitation. In addition, the fin spacing sensitivity to the thermal conductivity of the PCM was tested by considering thermal conductivities of 0.25, 0.5, and 1 W/m·K. The results in FIG. 11D show that thermal conductivity was a more sensitive parameter once the geometry of the heat exchanger was determined, assuming a constant temperature difference of 8.3° C. When high-conductivity Cu tubes and fins that fit the form of the tank were used, the discharge performance requirements were met with low-thermal conductivity PCMs (i.e., pure PCMs that are not doped with high-conductivity materials). With the conformal fins spaced at 15 mm, the performance metrics were met for low-conductivity PCMs.

Figure 12A:
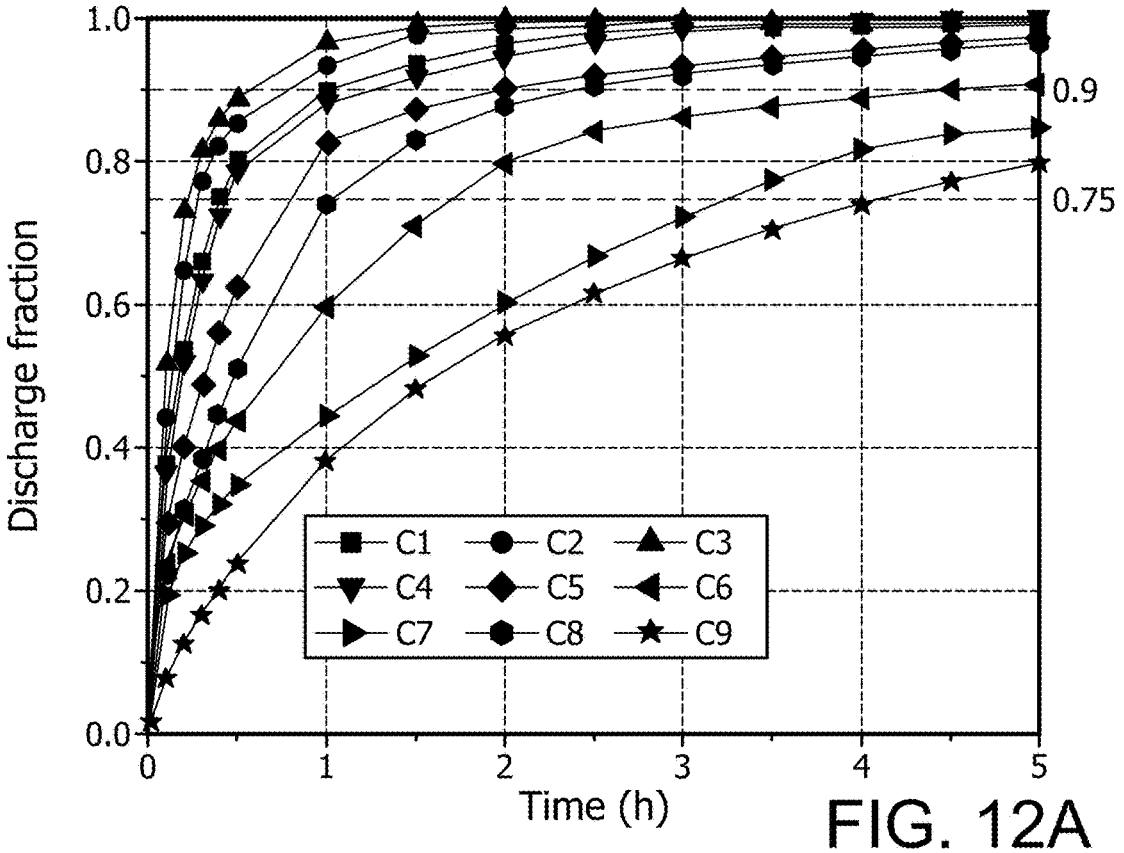
FIGS. 12A-12D illustrate discharging behavior of medium-scale TES system designs with the vertical-fin and horizontal-tube HX design.
Figure 12B:
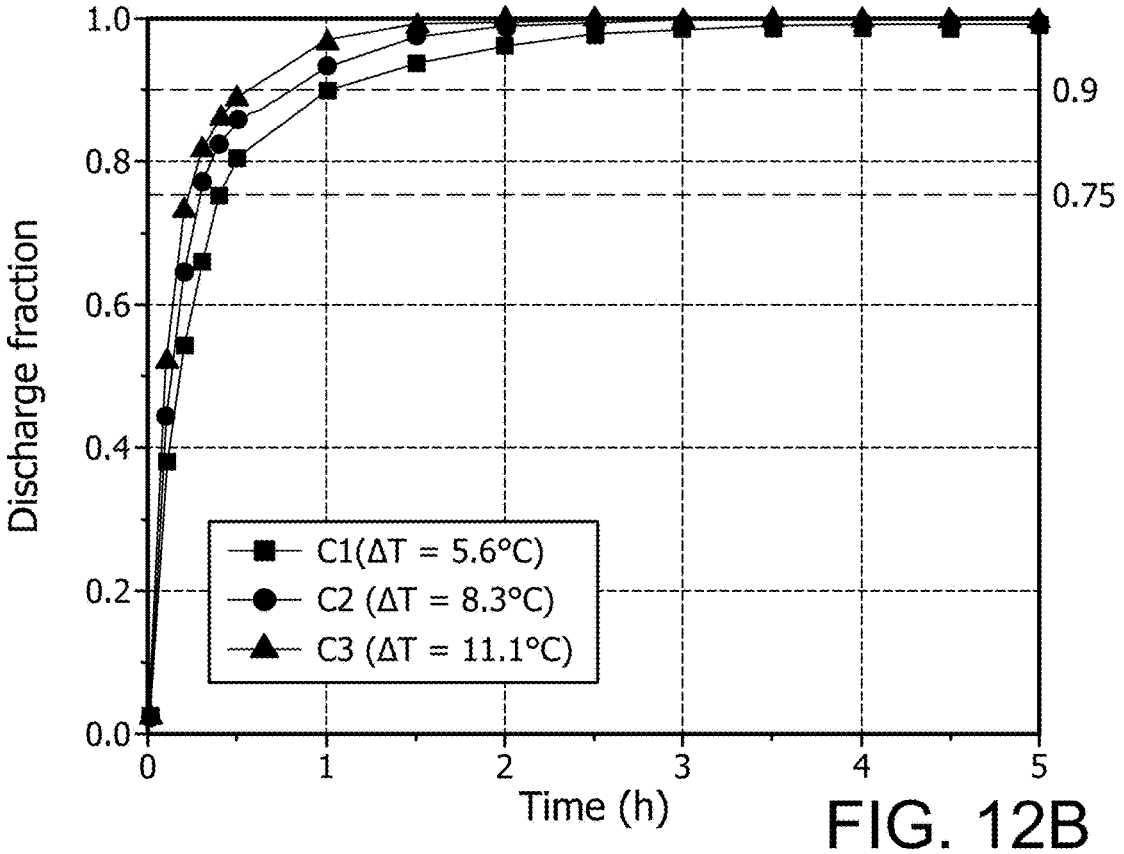
Figure 12C:
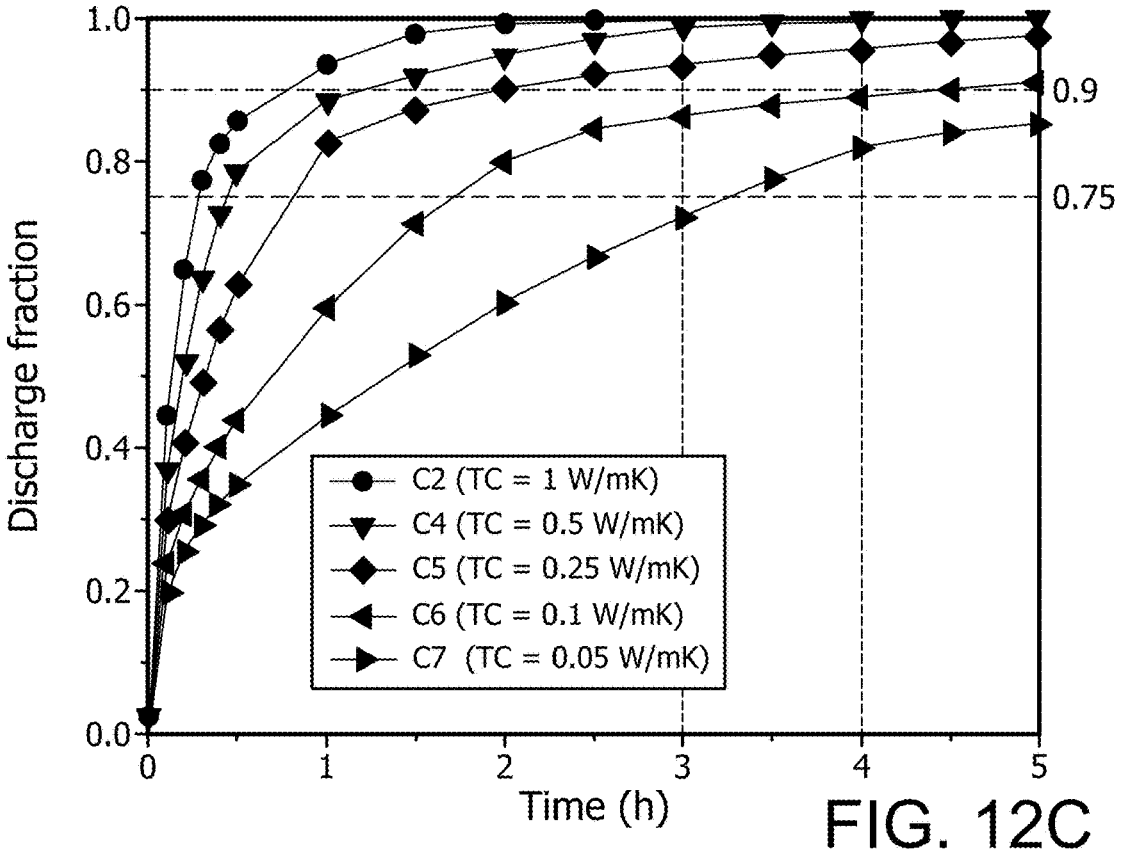
Figure 12D:
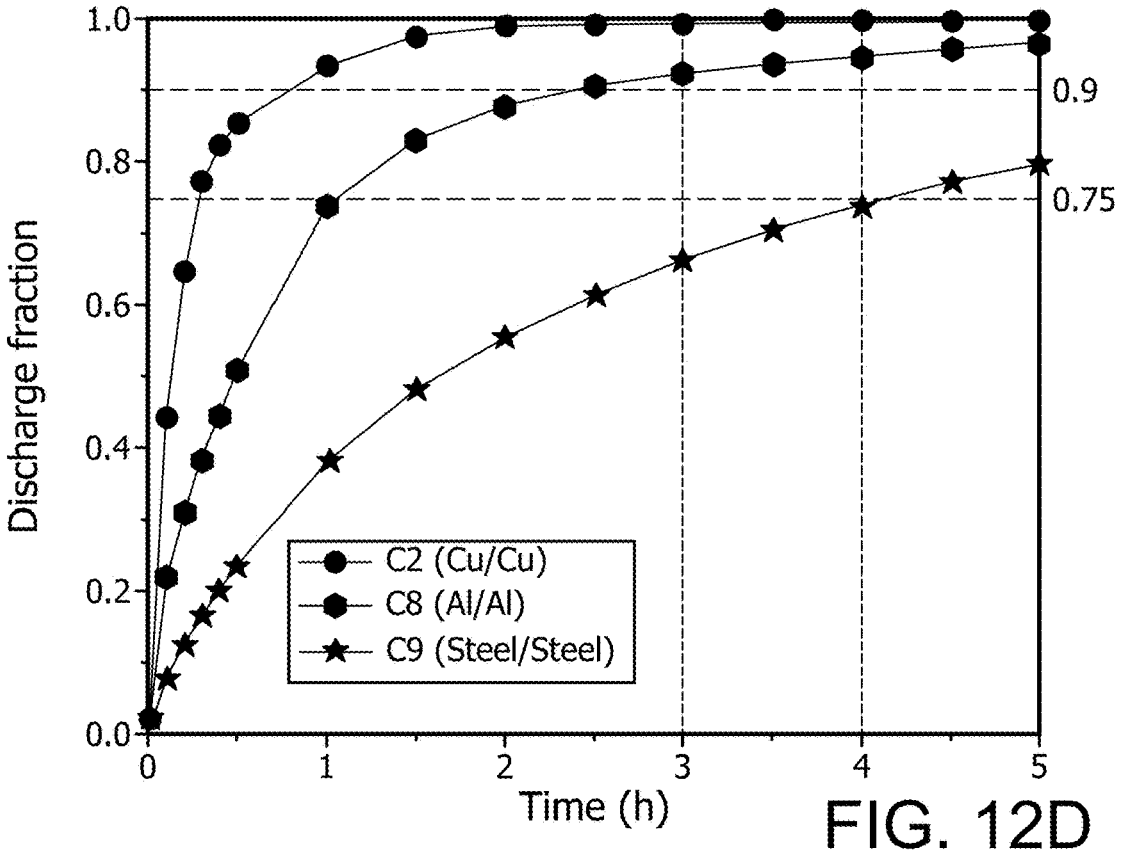

The model may be further adjusted by considering the lowest thermal conductivity of organic PCMs (<0.2 W/m·K). In addition, the constant temperature tube condition was replaced with empirically scaled thermal powers from the TABE system field evaluation. FIG. 4A-4D show the designed heat exchanger with 27 fins and 56 tubes. The fins had thicknesses of 1 mm and spacing of 15 mm, and the tubes had outer diameters of 9.53 mm and spacing of 41 mm. The medium-scale TES design had 27 fins and 56 tubes. The fins had thicknesses of 0.01 mm. The spacing between the tubes was 41 mm, and the spacing between the fins was 15.2 mm. The design's sensitivity to the temperature difference between the heat exchanger and the PCM, as well as the thermal conductivity of the PCM, were analyzed. The discharging behavior of the medium-scale TES system design is summarized in Table 4 and plotted in FIG. 12. Three design parameters (the difference between tube wall temperatures and the initial temperature of the PCM, thermal conductivity, and heat exchanger material) were studied to determine their effects on the PCM discharge fraction. FIG. 11B presents the effect of temperature differences set to 5.6° C., 8.3° C., and 11.1° C. The result indicates that temperature difference had a relatively moderate influence on discharge fraction. In addition, the sensitivity of discharge fraction to the thermal conductivity of the PCM was tested using thermal conductivities of 1, 0.5, 0.25, 0.1, and 0.05 W/m·K. The results show that thermal conductivity was a sensitive parameter once the geometry of the heat exchanger was determined, as shown in FIG. 12C, assuming a constant temperature difference. heat exchanger material significantly affects the discharge fraction, as shown in FIG. 12D Because of its high thermal conductivity, the Cu/Cu and Al/Al fin-tube heat exchanger design met the performance requirements. However, the steel/PEX design failed to meet the requirements because of the lower conductivities of these materials, as identified in Table 4.

TABLE 4

| Cases | Material (fin/tube[a]) | ΔT (° C.) | PCM thermal conductivity (W/m · K) | Tank volume utilization (%) | Discharge fraction in 3 h (—) | Discharge fraction in 4 h (—) | Parameter sensitivity (—) |
|---|---|---|---|---|---|---|---|
| C1 | Cu/Cu | 5.6 | 1 | 90.6 | 0.99 | 1.00 | Temperature |
| C2 | Cu/Cu | 8.3 | 1 | 90.6 | 1.00 | 1.00 | difference |
| C3 | Cu/Cu | 11.1 | 1 | 90.6 | 1.00 | 1.00 | |
| C4 | Cu/Cu | 8.3 | 0.5 | 90.6 | 0.99 | 1.00 | PCM thermal |
| C5 | Cu/Cu | 8.3 | 0.25 | 90.6 | 0.93 | 0.96 | conductivity |
| C6 | Cu/Cu | 8.3 | 0.1 | 90.6 | 0.86 | 0.89 | |
| C7 | Cu/Cu | 8.3 | 0.05 | 90.6 | 0.72 | 0.82 | |
| C8 | Al/Al | 8.3 | 1 | 90.6 | 0.92 | 0.95 | heat exchanger |
| C9 | Steel/PEX | 8.3 | 1 | 90.6 | 0.66 | 0.74 | material type |

Large Scale Heat Exchanger: (0.189 $m^3$ (50 gal))

Two 0.1893 $m^3$ (50 gal) large-scale TES systems were designed, one for a cooling application and one for a heating application, and their corresponding finite element models were established in COMSOL (using, for example, the medium scale models). Empirical considerations that affected the performance significantly (e.g., PCM enthalpy and range of phase change temperature) were retained in the large-scale analysis. The heat exchanger for the cooling application had a vertical-fin and horizontal-tube (VF-HT) configuration, as shown in FIGS. 2A-2D, to maximize the discharge rate by increasing the natural convection in the PCM during melting. For the heating application, the PCM must freeze from the bottom because most PCMs shrink upon freezing, and a horizontal-fin and vertical-tube (HF-VT) configuration as shown in FIGS. 3A-3D is desirable so that the coldest fluid in the tubes can be pumped from the bottom of the tank.

The design parameters of the large-scale and medium-scale TES systems are summarized in Table 5. The large-scale TES system with the VF-HT heat exchanger and the large-scale TES system with the HF-VT heat exchanger shared the same design parameters. For the large-scale system, the tubes had outer diameters of 9.54 mm (⅜ in) and varying wall thicknesses depending on the type of material used (e.g., PEX/steel or Al/Cu). Copper, Al, PEX, and steel were considered as heat exchanger materials. As they were in the medium-scale heat exchanger design analysis, parameters like temperature difference between the heat exchanger tube and the PCM and phase change (melting or freezing) temperature range (PCTR) were also considered in the sensitivity study for the large-scale design. At the larger scale, it becomes more obvious that multiple circuits of fluid need to be used in the HF-VT and many more circuits in the VF-HT design.

TABLE 5

| TES system | Tubes | | | Fin | | |
|---|---|---|---|---|---|---|
| | Total number (—) | Spacing (mm) | Outer diameter (mm) | Total number (—) | Spacing (mm) | Thickness (mm) |
| Large scale (50 gal) | 62 | 78 | 9.54 | 80 | 15 | 0.8 |
| Medium scale (5 gal) | 56 | 41 | 9.54 | 27 | 15 | 1.0 |

The discharging behavior of the large-scale TES system with a VF-HT heat exchanger is summarized in Table 6 and plotted in FIG. 13A-D. The design met the performance goals: 90% of the TES tank volume was utilized; 75% of the stored latent energy was discharged in 3 h, and 90% was discharged in 4 h; and a temperature difference of less than 5.6° C. was maintained between the heat exchanger and the PCM. heat exchanger material, mesh size, the temperature difference between the heat exchanger and the PCM (ΔT), and the PCTR were considered as parameters. A mesh sensitivity study was first conducted to ensure reliable results. The results indicate that the impact of the mesh size on the performance was negligible once a fine mesh was used. Therefore, the fine mesh was used in the remaining simulations.

Figure 13A:
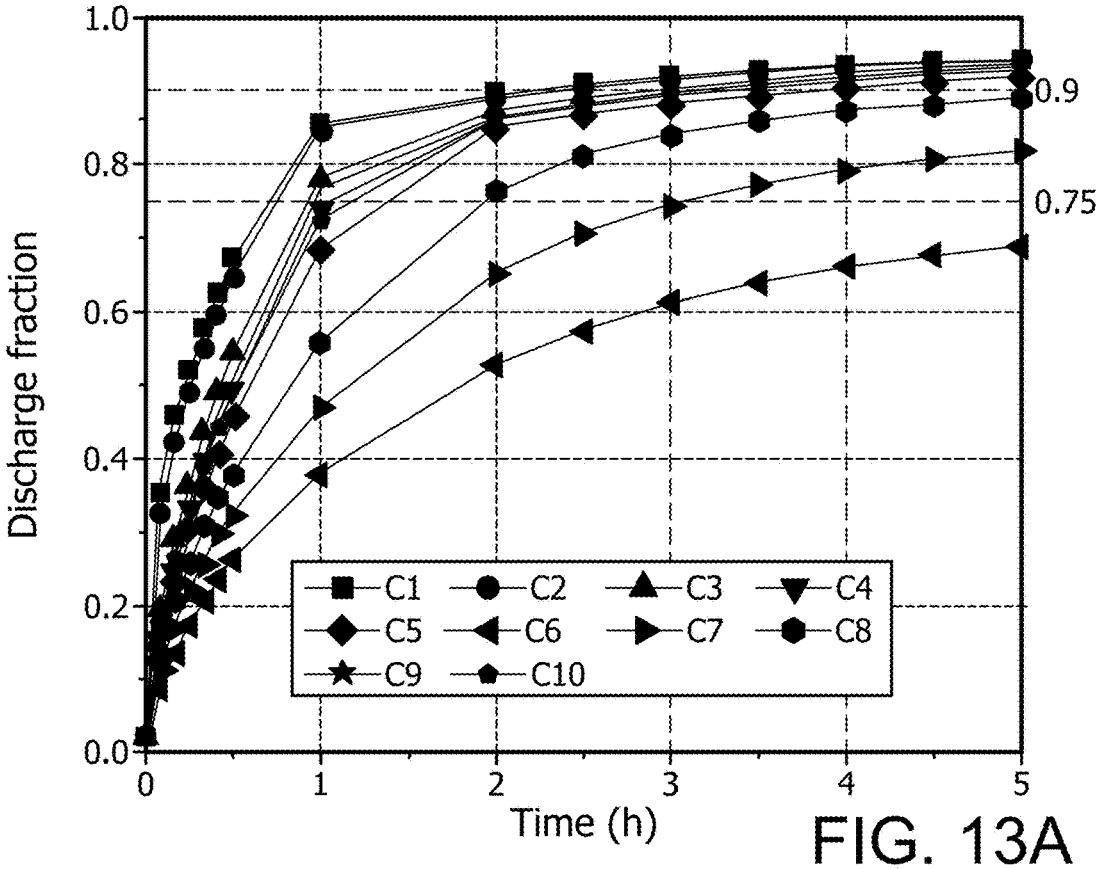
FIGS. 13A-13D illustrate discharging behavior of VF-HT designs.
Figure 13B:
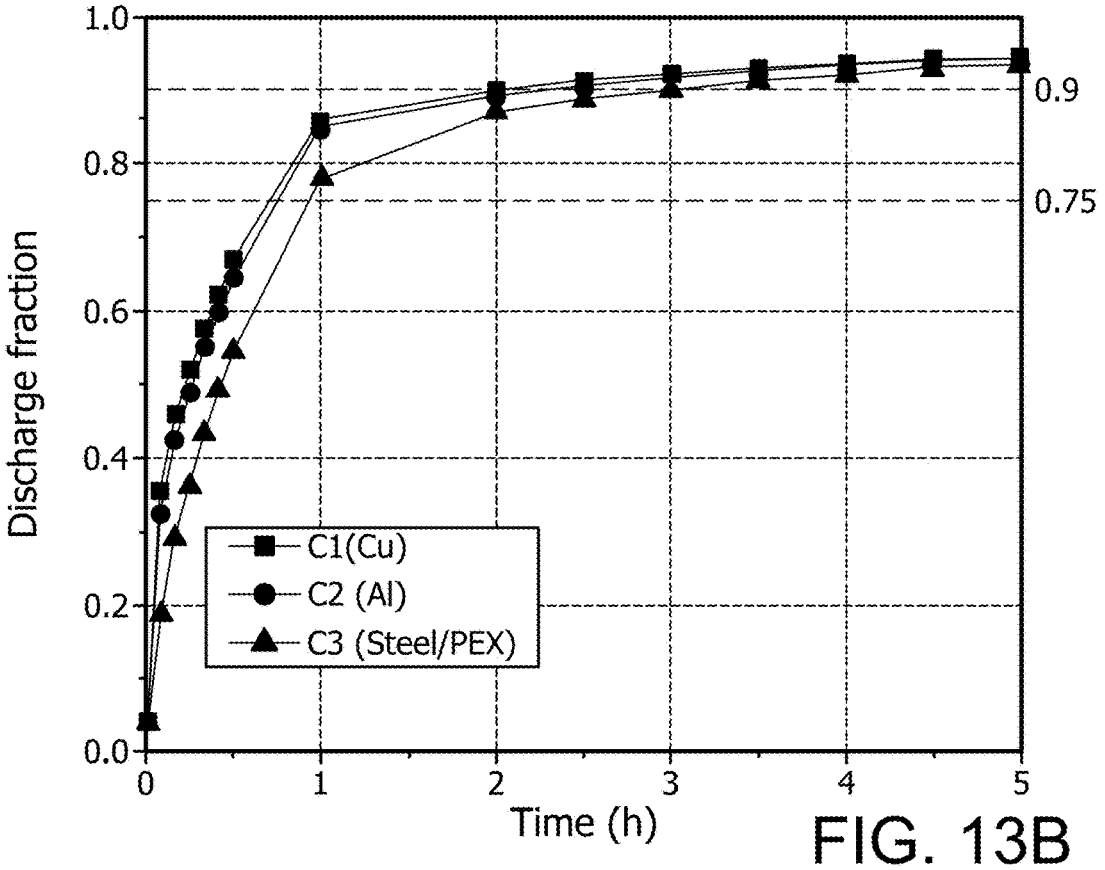

For heat exchanger tube/fin materials, Cu/Cu, Al/Al, and PEX/steel were used. The large-scale heat exchanger design was not sensitive to the heat exchanger materials, as shown in FIG. 13B, because the designed heat exchanger had a relatively compact arrangement (i.e., the medium spacing between the tubes and fins enhanced the heat transfer between the heat exchanger and the PCM even though the PCM had a relatively low thermal conductivity). The discharging history showed no obvious difference between Cu/Cu (or Al/Al) and steel/PEX during the initial stage of the discharging (<1 h). This was due to the low thermal conductivity of PEX (0.41 W/m·K) compared with Cu (390 W/m·K) and Al (276 W/m·K).

Figure 13C:
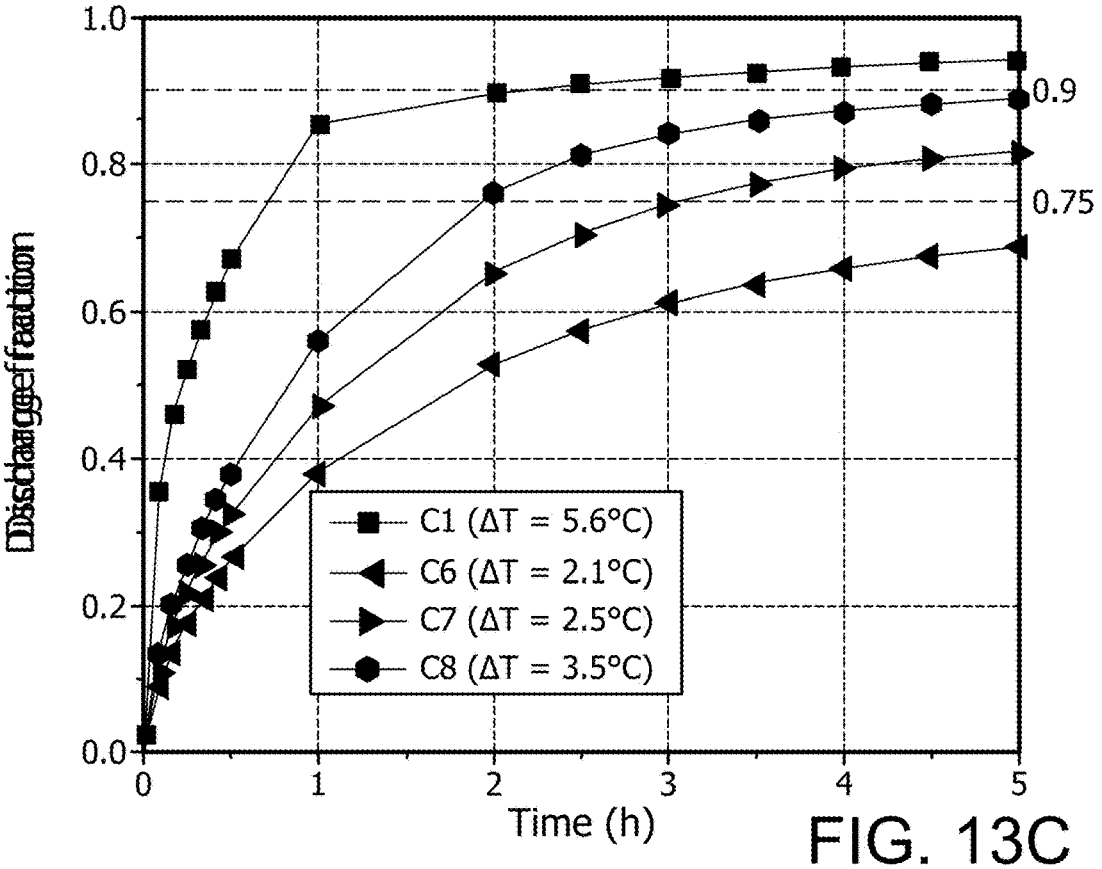
Figure 13D:
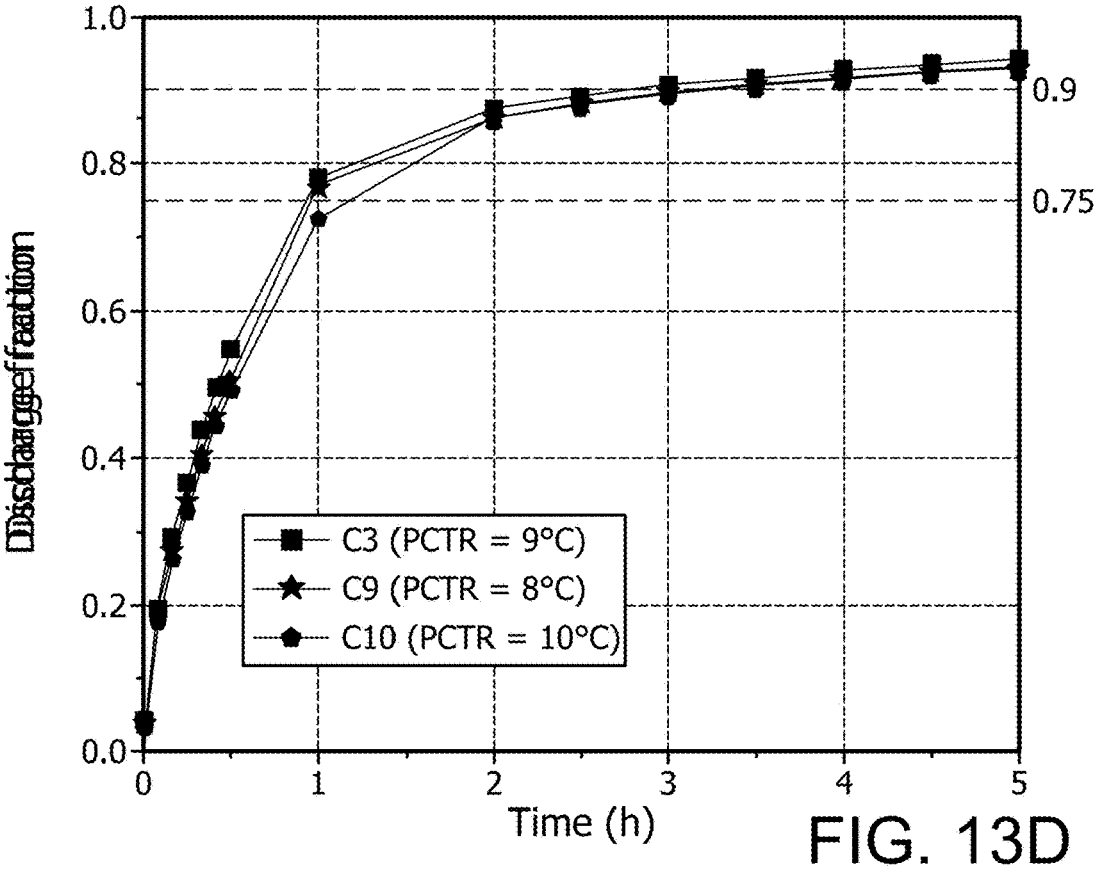
Figure 14A:
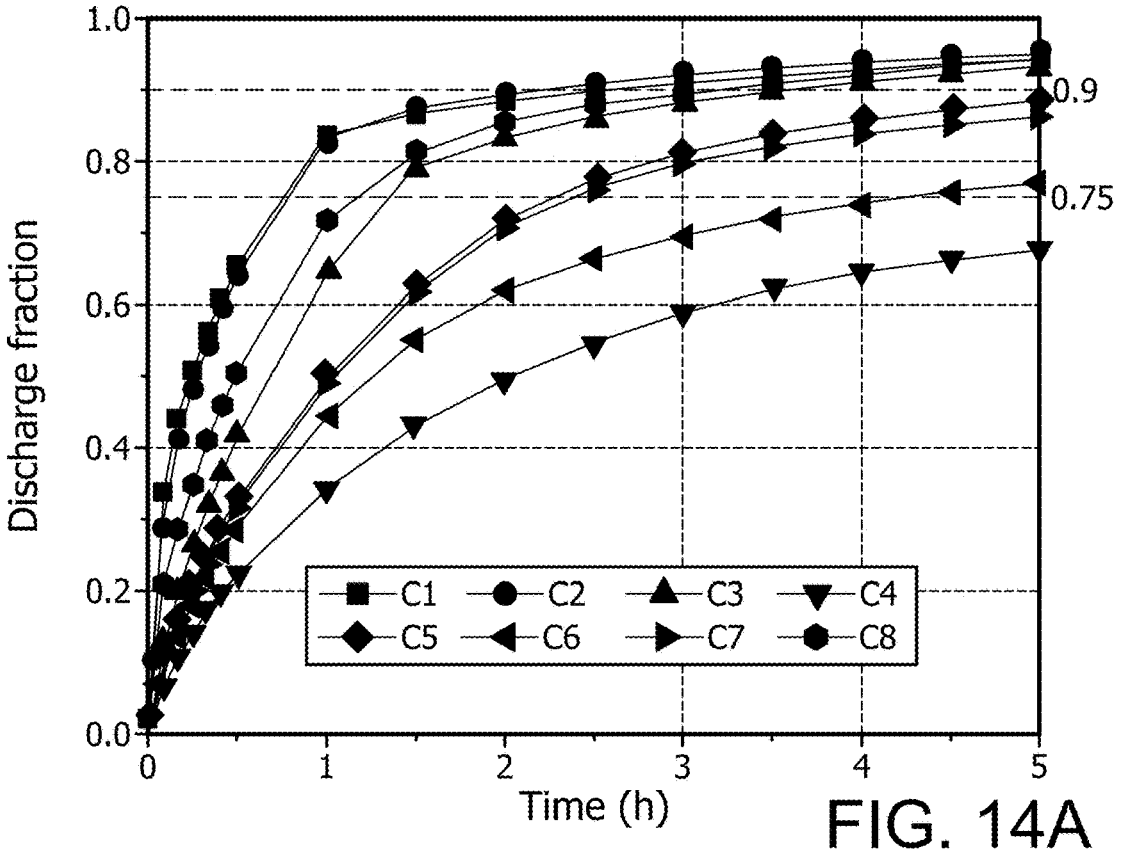
FIGS. 14A-14D illustrate discharging behavior of HF-VT designs.
Figure 14B:
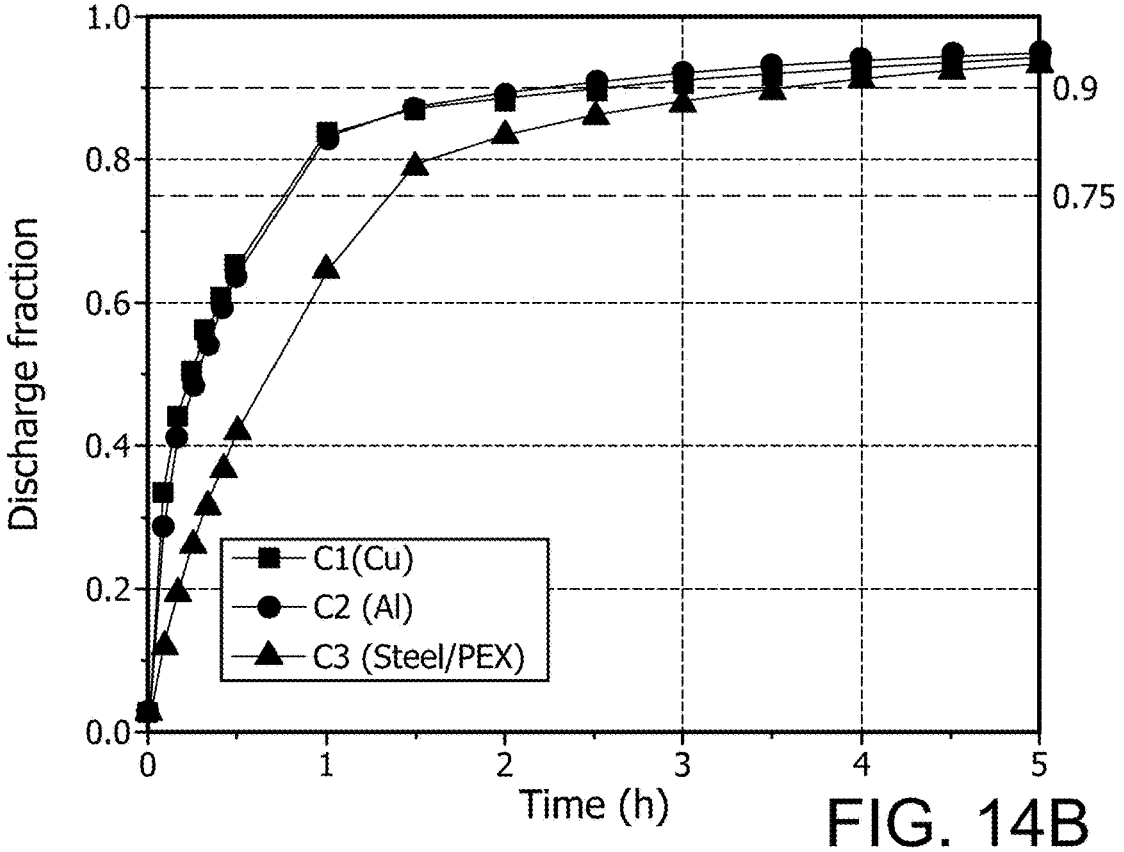
Figure 14C:
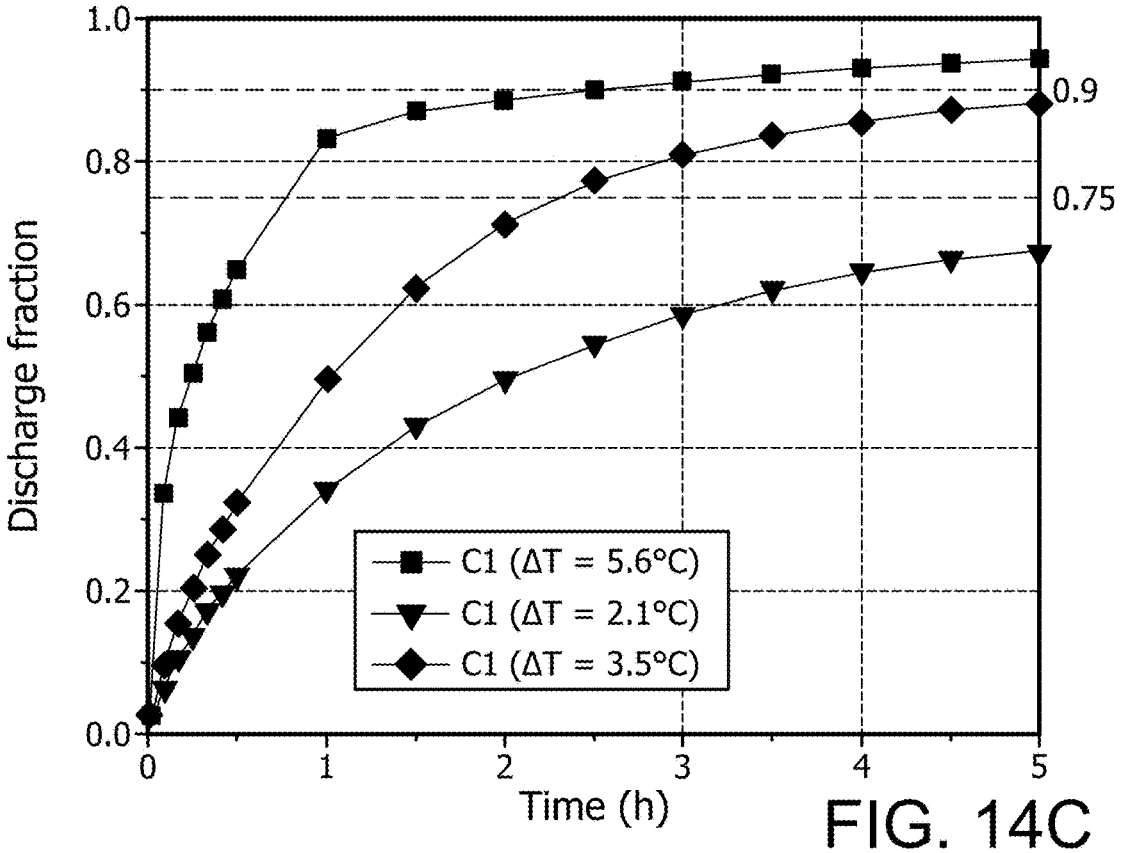
Figure 14D:
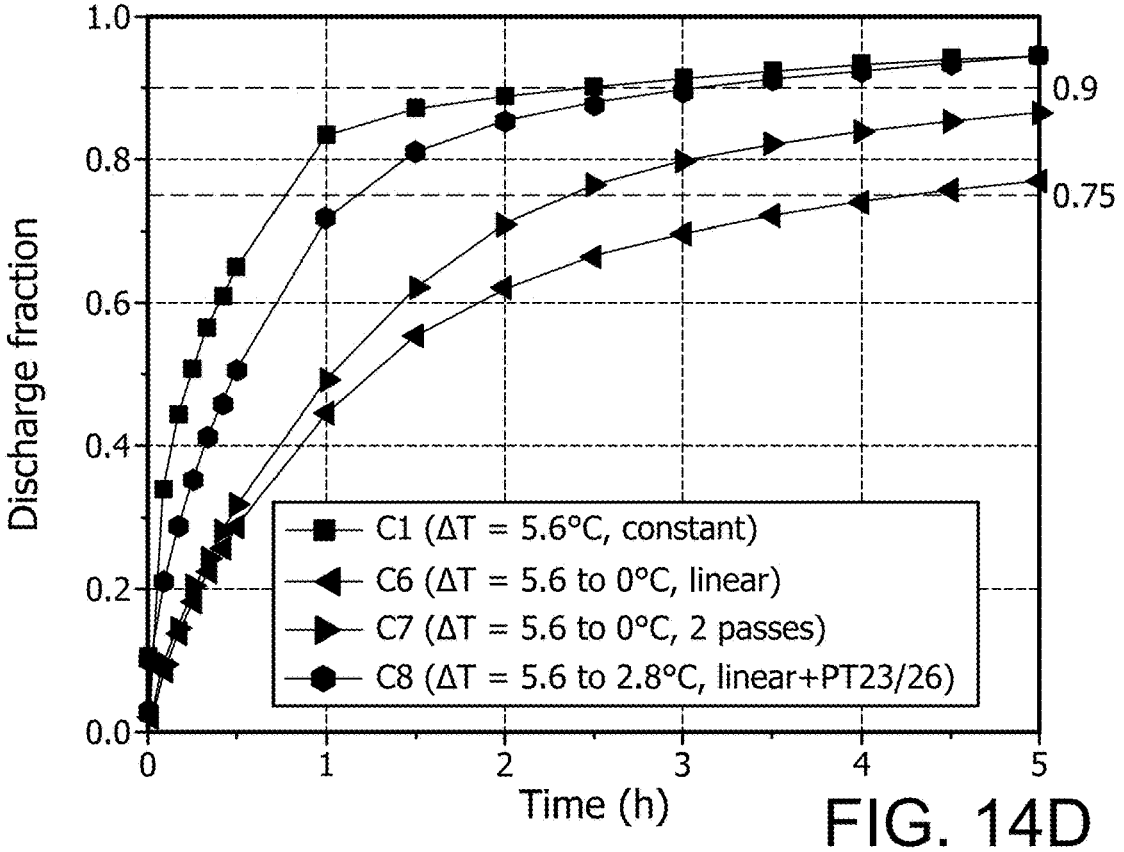

The discharging volume fraction was very sensitive to the temperature difference between the heat exchanger and the PCM, as shown in FIG. 13C. Reducing the temperature difference from 5.6° C. to 3.5° C. greatly reduced the discharge fraction during the initial stage; nevertheless, the design met the performance goals. However, the design did not meet all the performance goals when the temperature difference between the heat exchanger and the PCM was reduced to 2.5° C. and 2.1° C. (When the temperature difference was 2.5° C., the design achieved 75% discharge in 3 h but did not meet the other performance goals.) Therefore, a relatively large temperature difference between (>3.5° C.) the heat exchanger and the PCM is important for a VF-HT design to perform well. As shown in FIG. 13D, the discharge fraction was not sensitive to the PCTR, likely because of the large area of heat exchange in the finned design.

TABLE 6

| Cases | Material (fin/tube[a]) | Mesh size (—) | ΔT (° C.) | Tank volume utilization (%) | Discharge fraction in 3 h (—) | Discharge fraction in 4 h (—) | Parameter sensitivity (—) |
|---|---|---|---|---|---|---|---|
| C1 | Cu/Cu | Fine | 5.6 | 90.3 | 0.92 | 0.93 | heat exchanger |
| C2 | Al/Al | Fine | 5.6 | 90.3 | 0.92 | 0.93 | material |
| C3 | PEX/Steel[b] | Fine | 5.6 | 90.3 | 0.88 | 0.90 | |
| C4 | Cu/Cu | Finer | 5.6 | 90.3 | 0.89 | 0.92 | Mesh size |
| C5 | Cu/Cu | Extra fine | 5.6 | 90.3 | 0.89 | 0.91 | |
| C6 | Cu/Cu | Fine | 2.1 | 90.3 | 0.61 | 0.66 | Temperature |
| C7 | Cu/Cu | Fine | 2.5 | 90.3 | 0.74 | 0.79 | difference |
| C8 | Cu/Cu | Fine | 3.5 | 90.3 | 0.84 | 0.87 | between heat exchanger and PCM |
| C9 | Cu/Cu | Fine | 3.5 | 90.3 | 0.89 | 0.92 | PCTR reduced to 8 |
| C10 | Cu/Cu | Fine | 4.5 | 90.3 | 0.89 | 0.91 | PCTR increased to 10 |

The discharging behavior of the large-scale TES system with a HF-VT heat exchanger is summarized in Table 7 and plotted in FIG. 14. This design met the performance goals for the heat exchanger. Similar discharging behavior was observed for different heat exchanger materials when the temperature difference between the heat exchanger and the PCM was held constant. In large-scale TES systems, the temperature along the length of a given tube often varies significantly because the heat transfer fluid exchanges heat with the PCM. To study the effect of inconsistent tube temperatures, the temperature along the tube was varied linearly for a decreasing ΔT. A practical way to reduce the temperature difference along the tube is to increase the flow rate of the heat transfer fluid. However, doing so requires increased pumping power and thus decreases energy efficiency.

TABLE 7

| Cases | Material (tube/fin) | Mesh size (—) | ΔT (° C.) | Tank volume utilization (%) | Discharge fraction in 3 h (—) | Discharge fraction in 4 h (—) | Parameter sensitivity (—) |
|---|---|---|---|---|---|---|---|
| C1 | Cu[a]/Cu | Fine | 5.6 | 90.3 | 0.91 | 0.93 | heat exchanger material |
| C2 | Al[a]/Al | Fine | 5.6 | 90.3 | 0.92 | 0.94 | |
| C3 | PEX[b]/Steel | Fine | 5.6 | 90.3 | 0.88 | 0.91 | |
| C4 | Cu[a]/Cu | Fine | 2.1 | 90.3 | 0.59 | 0.65 | Temperature difference |
| C5 | Cu[a]/Cu | Fine | 3.5 | 90.3 | 0.81 | 0.86 | |
| C6 | Cu[a]/Cu | Fine | 5.6 to 0 (linear) | 90.3 | 0.70 | 0.74 | Temperature difference linearly decreased along the length of the 62 tubes from 5.6° C. to 0° C. |
| C7 | Cu[a]/Cu | Fine | 5.6 to 0 (2 passes) | 90.3 | 0.80 | 0.84 | Temperature difference linearly decreased along the length of the 62 tubes from 5.6° C. to 0° C. Interior circuit of 31 tubes transferred to outer circuit of 31 tubes |
| C8 | Cu[a]/Cu | Fine | 5.6 to 2.8 (linear) | 90.3 | 0.90 | 0.92 | Temperature difference linearly decreased along the length of the 62 tubes 5.6° C. to 2.8° C. above PT26 First two-thirds of the storage volume PCM PT26 second third is PT23 |

The results indicate that commercially available organic PCMs with low conductivities (<0.3 W/m·K) can have charge and discharge times appropriate for building TES (i.e., 4-5 h) with fin-tube heat exchanger designs that cost between $5/kWh and $26/kWh, even when the temperature difference between the heat transfer fluid and the PCM phase change temperature is small (5.56° C.). PCM thermal storage systems often require larger ΔT values to access the high-energy storage density material. For this study, a conservative ΔT of 5.6° C. was chosen to meet the performance requirements, although higher and lower ΔT values were also explored.

With 6.35 mm diameter tubes spaced 7.8 cm apart, the Al, Cu, and steel fins with spacing of 1.5 cm discharged 75% in 3 h and 90% in 4 h. In this same design, the volume taken up by the heat exchanger was <10% of the container when the thinnest fins (0.398 mm) were used. Throughout the scale-up process, fin spacing was the parameter that most affected performance, and tube spacing was a close second; the tube size, and fin thickness could be changed without large changes in performance. The thickness of the fin did not significantly affect the performance because the thermal conductivity of the metal fins is about 1,000 times that of the PCM.

Figure 15:
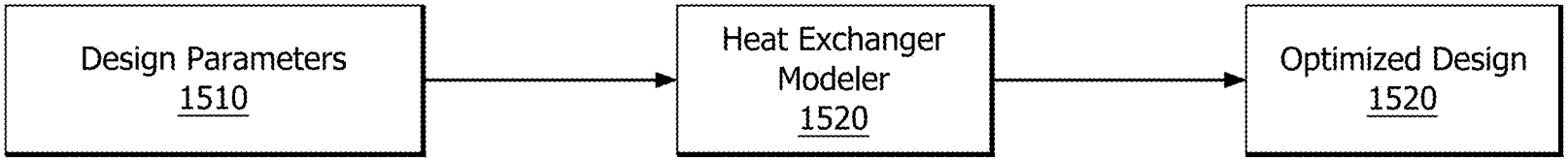
FIG. 15 illustrates an example system in accordance with this disclosure.
Figure 16:
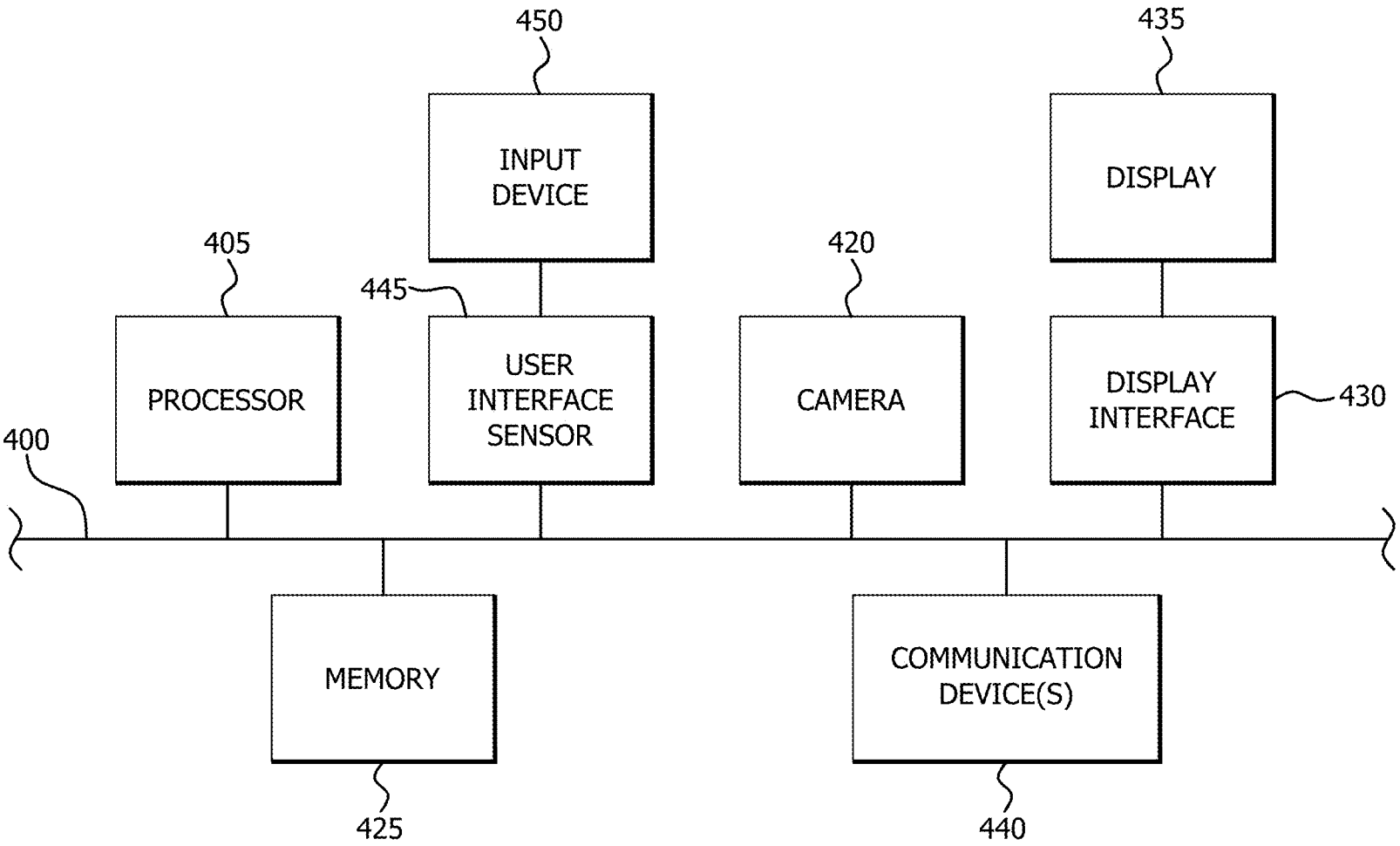
FIG. 16 is a block diagram that illustrates various elements of a possible electronic system, subsystem, controller and/or other component of the system of FIG. 15, and/or external electronic device.

A system in accordance with one embodiment is shown in FIG. 15 and generally designated 1500. The system may include a heat exchanger modeler 1520 operable to receive design parameters 1510 for a heat exchanger to generate and store heat exchanger optimized design 1530, in accordance with the principles of this disclosure.

FIG. 4 depicts an example of internal hardware that may be included in heat exchanger modeler (e.g., 1520), external monitoring and reporting systems, or remote servers. An electrical bus 400 serves as an information highway interconnecting the other illustrated components of the hardware. Processor 405 is a central processing device of the system, configured to perform calculations and logic operations required to execute programming instructions. As used in this document and in the claims, the terms "processor" and "processing device" may refer to a single processor or any number of processors in a set of processors that collectively perform a set of operations, such as a central processing unit (CPU), a graphics processing unit (GPU), a remote server, or a combination of these. Read only memory (ROM), random access memory (RAM), flash memory, hard drives and other devices capable of storing electronic data constitute examples of memory devices 425. A memory device may include a single device or a collection of devices across which data and/or instructions are stored. Various embodiments of the invention may include a computer-readable medium containing programming instructions that are configured to cause one or more processors to perform the functions described in the context of the previous figures.

An optional display interface 416 may permit information from the bus 400 to be displayed on a display device 435 in visual, graphic or alphanumeric format, such as a graphical user interface of a welder. An audio interface and audio output (such as a speaker) also may be provided. Communication with external devices may occur using various communication devices 440 such as a wireless antenna, a radio frequency identification (RFID) tag and/or short-range or near-field communication transceiver, each of which may optionally communicatively connect with other components of the device via one or more communication system. The communication device(s) 440 may be configured to be communicatively connected to a communications network, such as the Internet, a local area network or a cellular telephone data network.

The hardware may also include a user interface sensor 445 that allows for receipt of data from input devices 450 such as a keyboard or keypad, a joystick, a touchscreen, a touch pad, a remote control, a pointing device and/or microphone. Digital image frames also may be received from a camera 420 that can capture video and/or still images.

The above-disclosed features and functions, as well as alternatives, may be combined into many other different systems or applications. Various components may be implemented in hardware or software or embedded software. Various presently unforeseen or unanticipated alternatives, modifications, variations or improvements may be made by those skilled in the art, each of which is also intended to be encompassed by the disclosed embodiments.

Terminology that is relevant to the disclosure provided above includes:

As used herein, the terms "coupled," "coupled to," and "coupled with," each mean a structural and/or electrical connection, whether attached, affixed, connected, joined, fastened, linked, and/or otherwise secured. As used herein, the term "attach" means to affix, couple, connect, join, fasten, link, and/or otherwise secure. As used herein, the term "connect" means to attach, affix, couple, join, fasten, link, and/or otherwise secure.

An "electronic device" or a "computing device" refers to a device that includes a processor and memory. Each device may have its own processor and/or memory, or the processor and/or memory may be shared with other devices as in a virtual machine or container arrangement. The memory will contain or receive programming instructions that, when executed by the processor, cause the electronic device to perform one or more operations according to the programming instructions.

The terms "memory," "memory device," "data store," "data storage facility" and the like each refer to a non-transitory device on which computer-readable data, programming instructions or both are stored. Except where specifically stated otherwise, the terms "memory," "memory device," "data store," "data storage facility" and the like are intended to include single device embodiments, embodiments in which multiple memory devices together or collectively store a set of data or instructions, as well as individual sectors within such devices.

The terms "processor" and "processing device" refer to a hardware component of an electronic device that is configured to execute programming instructions. Except where specifically stated otherwise, the singular term "processor" or "processing device" is intended to include both single-processing device embodiments and embodiments in which multiple processing devices together or collectively perform a process.

In this document, the terms "communication link" and "communication path" mean a wired or wireless path via which a first device sends communication signals to and/or receives communication signals from one or more other devices. Devices are "communicatively connected" if the devices are able to send and/or receive data via a communication link. "Electronic communication" refers to the transmission of data via one or more signals between two or more electronic devices, whether through a wired or wireless network, and whether directly or indirectly via one or more intermediary devices.

In this document, when relative terms of order such as "first" and "second" are used to modify a noun, such use is simply intended to distinguish one item from another, and is not intended to require a sequential order unless specifically stated.

In addition, terms of relative position such as "vertical" and "horizontal", or "front" and "rear", when used, are intended to be relative to each other and need not be absolute, and only refer to one possible position of the device associated with those terms depending on the device's orientation.

The invention claimed is:

1. A heat storage system comprising:

a heat exchanger comprising:

a plurality of planar fins parallelly arranged between a first header and a second header and have a plurality of holes through the fins, subsets of the plurality of holes in the fins being axially aligned;

a plurality of tubes configured to be received in the axially aligned subsets of holes through the plurality of fins, the plurality of tubes being configured to allow flow of a fluid exchanger fluid;

a storage tank comprising phase change material (PCM), wherein the heat exchanger is configured to be at least partially submerged within the PCM;

wherein the number of tubes is less than the number of subsets of axially aligned holes, and wherein a spacing between the plurality of fins and a spacing between the plurality of tubes satisfies the following ratios:

fin spacing/tube spacing=0.1 to 0.2;

fin spacing/fin thickness=2.3 to 125;

fin spacing/PCM conductivity=0.5 to 7.5; and fin spacing (inch)/PCM volumetric latent heat (kJ/m$^3$)= 0.0000047 to 0.0000006;

and wherein the heat storage system discharges at least 75% thermal heat discharge from the PCM in about 3 hours.

2. The heat storage system of claim 1, wherein the spacing is about 0.75 inch to about 0.14 inch.

3. The heat storage system of claim 1, wherein a thickness of each of the plurality of fins is about 0.006 inch to about 0.06 inch.

4. The heat storage system of claim 1, wherein a spacing between the plurality of tubes is about 2 inches to about 4 inches.

5. The heat storage system of claim 4, wherein a diameter of each of the plurality of tubes is about 0.375 inch to 0.16 inch.

6. The heat storage system of claim 1, wherein the spacing is optimized to satisfy at least one of the following ratios:

$$\frac{\text{Fins spacing}}{\text{tube diameter}} = 0.9 \text{ to } 2$$

$$\frac{\text{Fin spacing (inch)}}{\text{PCM specific latent heat}\left(\frac{kJ}{kg}\right)} = 0.0042 \text{ to } 0.0006.$$

7. The heat storage system of claim 1, wherein the heat exchanger is a vertical finned horizontal tube exchanger.

8. The heat storage system of claim 1, wherein the heat exchanger is a horizonal finned vertical tube exchanger.

9. The heat storage system of claim 1, wherein one or more of the plurality of tubes comprise a twisted tape insert.

* * * * *